US011007626B2

(12) United States Patent
Ishizaki et al.

(10) Patent No.: US 11,007,626 B2
(45) Date of Patent: May 18, 2021

(54) SCREW-FEEDING APPARATUS AND SCREW-TIGHTENING APPARATUS WITH SCREW-FEEDING APPARATUS

(71) Applicant: MAKITA CORPORATION, Anjo (JP)

(72) Inventors: Yuki Ishizaki, Anjo (JP); Takeshi Kamiya, Anjo (JP)

(73) Assignee: MAKITA CORPORATION, Anjo (JP)

( * ) Notice: Subject to any disclaimer, the term of this patent is extended or adjusted under 35 U.S.C. 154(b) by 313 days.

(21) Appl. No.: 16/171,780

(22) Filed: Oct. 26, 2018

(65) Prior Publication Data

US 2019/0168363 A1 Jun. 6, 2019

(30) Foreign Application Priority Data

Dec. 5, 2017 (JP) ..... JP2017-233679

(51) Int. Cl.
*B25B 23/04* (2006.01)
*B25B 21/00* (2006.01)
*B25F 5/00* (2006.01)

(52) U.S. Cl.
CPC ..... *B25B 23/045* (2013.01); *B25B 21/00* (2013.01); *B25F 5/001* (2013.01)

(58) Field of Classification Search
CPC ..... B25B 23/045; B25B 21/00; B25B 23/06; B25B 23/04; B25B 23/10; B25F 5/001; B23P 19/006
See application file for complete search history.

(56) References Cited

U.S. PATENT DOCUMENTS 5,904,079 A * 5/1999 Tsuge ..... B25B 23/045 81/434
7,231,854 B2 * 6/2007 Kikuchi ..... B25B 23/045 227/136
7,424,840 B1 * 9/2008 Huang ..... B25C 5/1627 81/435
2004/0112183 A1 * 6/2004 Huang ..... B25B 23/0064 81/434

FOREIGN PATENT DOCUMENTS

JP 4871708 B2 2/2012

* cited by examiner

*Primary Examiner* — Robert J Scruggs
(74) *Attorney, Agent, or Firm* — J-Tek Law PLLC; Jeffrey D. Tekanic; Scott T. Wakeman

(57) ABSTRACT

An autofeed attachment (4) for a screw-driving apparatus (2) includes a base casing (30), a feeder casing (32) slidably mounted on the base casing (30) and a wheel (72) rotatably mounted within the feeder casing (32). When rotated in a forward direction, the wheel (72) advances a screw strip (50), which has a plurality of screws (52) coupled by a connecting strip. A wheel forward-direction rotating mechanism (60, 64, 66, 68) rotates the wheel (72) in the forward direction and restricts rotation of the wheel (72) in a reverse direction opposite the forward direction. A wheel-release mechanism (70, 107, 117) releases the restriction placed on rotation of the wheel (72) in the reverse direction. The wheel forward-direction rotating mechanism and the wheel-release mechanism are disposed, at least partially, inside of the wheel (72) and/or the rotational axis of the wheel (72) intersects a release button (107) of the wheel-release mechanism.

22 Claims, 13 Drawing Sheets

SCREW-FEEDING APPARATUS AND SCREW-TIGHTENING APPARATUS WITH SCREW-FEEDING APPARATUS

CROSS-REFERENCE

The present application claims priority to Japanese patent application serial number 2017-233679 filed on Dec. 5, 2017, the contents of which are incorporated fully herein by reference.

TECHNICAL FIELD

The present invention relates to a screw-feeding apparatus, such as an autofeed attachment, and to a screw-tightening apparatus, such as a screwdriver.

BACKGROUND ART

Japanese Patent No. 4871708 (Patent Document 1) discloses a screw-feeding apparatus 1 of a continuous screw-tightening apparatus 10 that comprises: a base casing 2; a feeder casing 3, which is mounted thereon such that it is movable in a front-rear direction between an interpolated (retracted) state and a protruding (extended) state; and a screw-supplying mechanism 4, which is provided in the interior thereof.

The screw-supplying mechanism 4 comprises, in a front-rear aligned state: a ratchet wheel 4a, which meshes with a band (strip) 9a of a screw-connecting band (screw strip) 9; an intermediate gear 4b, which meshes with the ratchet wheel 4a; and an arm 4c, which is mounted so to be tiltable at a fixed angle with respect to the axial center thereof.

A one-way clutch is formed between the arm 4c and the intermediate gear 4b. In addition, a roller pin 4d is provided on a tilting-tip part of the arm 4c. The roller pin 4d is contained in a slot 2e formed in the base casing 2. A front part of the slot 2e is lower on the front side, and other portions of the slot 2e are oriented in the front-rear direction.

Furthermore, the feeder casing 3 is moved (retracted) to the interpolated (retracted) state as the screw tightening operation is being performed. When the feeder casing 3 is being moved to the protruding state after completion of the screw tightening operation, the arm 4c is reciprocatively tilted by the roller pin 4d, which passes through the slot 2e. Therefore, at the end of the screw tightening operation, the ratchet wheel 4a advances the screw-connecting band 9 by 1 pitch (a single screw 9b) only upward using the one-way clutch and the intermediate gear 4b.

SUMMARY OF THE INVENTION

In the screw-feeding apparatus 1 of Japanese Patent No. 4871708, the screw-supplying mechanism 4 comprises the ratchet wheel 4a, the intermediate gear 4b, and the arm 4c in a front-rear aligned (sequentially-disposed) state. Therefore, the screw-supplying mechanism 4 is relatively long in the front-rear direction of the screw-feeding apparatus 1.

In addition, in the screw-supplying mechanism 4 of Japanese Patent No. 4871708, the ratchet wheel 4a, the intermediate gear 4b, and the arm 4c are exposed to the interior of the feeder casing 3. Therefore, dust can enter the feeder casing 3 and adversely affect the operation of the screw-supplying mechanism 4.

Furthermore, in the screw-supplying mechanism 4 of Japanese Patent No. 4871708, there is no disclosure concerning a means for temporarily releasing the one-way clutch; consequently, it is difficult to withdraw the screw-connecting band (screw strip) 9 downward before all of the screws 9b in the screw-connecting band 9 have been used up.

Accordingly, one non-limiting object of the present teachings is to provide a screw-feeding apparatus and a screw-tightening apparatus with screw-feeding apparatus that is more compact (shorter) in the front-rear direction.

In addition or in the alternative, another non-limiting object of the present teachings is to provide a screw-feeding apparatus and a screw-tightening apparatus with screw-feeding apparatus in which durability with respect to dust is improved.

In addition or in the alternative, another non-limiting object of the present teachings is to provide a screw-feeding apparatus and a screw-tightening apparatus with screw-feeding apparatus in which it is possible to easily withdraw the screw-connecting band (screw strip) in the downward direction.

In a first aspect of the present teachings, a screw-feeding apparatus preferably comprises: a base casing that is mountable on a screw-tightening apparatus (e.g., a screwdriver); a feeder casing, which is mounted on the base casing such that it is movable relative to the base casing in a tightening (axial, longitudinal) direction of a screw; a wheel, which is provided inside the feeder casing and is adapted to advance, by rotating in a forward direction, a screw strip (i.e. a plurality of screws coupled by (detachably attached to) a connecting strip); a wheel forward-direction rotating mechanism adapted to rotate the wheel in the forward direction and restrict rotation of the wheel in a reverse direction that is opposite of the forward direction; and a wheel-release (wheel-free) mechanism that releases the restriction placed by the wheel forward-direction rotating mechanism on rotation in the reverse direction. The wheel forward-direction rotating mechanism and the wheel-release mechanism are preferably disposed, at least partially and more preferably at least substantially, inside (in the interior) of the wheel.

In a second aspect of the present teachings, the wheel forward-direction rotating mechanism preferably comprises: a first cam; a second cam connected to the wheel so as rotate therewith and adapted such that the second cam engages the first cam during rotation of the wheel in the reverse direction; and a third cam that is adapted to engage the second cam during rotation of the wheel in the reverse direction. Furthermore, the wheel-release mechanism includes a shaft that is adapted to move at least any two of the first cam, the second cam, and the third cam and separates the first cam and the third cam from the second cam so that the second cam becomes free to rotate in the reverse direction.

In a third aspect of the present teachings, a screw-feeding apparatus comprises: a base casing adapted to be mounted on a screw-tightening apparatus; a feeder casing, which is mounted on the base casing and is movable relative to the base casing in a front-rear direction, which is a tightening direction of a screw; a wheel, which is provided inside the feeder casing such that an (its) axial direction extends a left-right direction and is adapted to advance, by rotating in a forward direction, a screw strip (a plurality of screws coupled by (attached to) a connecting strip); a wheel forward-direction rotating mechanism that rotates the wheel in the forward direction and restricts rotation in a reverse direction; and a wheel-release (wheel-free) mechanism that releases the restriction placed by the wheel forward-direction rotating mechanism on rotation in the reverse direction. The wheel-release mechanism is aligned with the wheel in an up-down direction.

In a fourth aspect of the present teachings, a screw-tightening apparatus has any one of the above-mentioned screw-feeding apparatus mounted thereon.

With regard to the arrangement of the wheel forward-direction rotating mechanism and the wheel-release mechanism inside (in the interior) of the wheel, "at least partially" means that at least 30% of a longitudinal (axial) extension of the wheel forward-direction rotating mechanism and the wheel-release mechanism is disposed (physically exists) between outer edges or outer flanges of the wheel. Furthermore, "at least substantially" means that at least 50% of the longitudinal (axial) extension of the wheel forward-direction rotating mechanism and the wheel-release mechanism is disposed (physically exists) between the outer edges or outer flanges of the wheel, more preferably at least 60%, at least 70%, at least 80% or at least 90% of the longitudinal (axial) extension of the wheel forward-direction rotating mechanism and the wheel-release mechanism is disposed (physically exists) between the outer edges or outer flanges of the wheel.

In addition or in the alternative, the wheel may have a first rotational axis, the wheel forward-direction rotating mechanism may have a second rotational axis (first longitudinal axis) and the wheel-release mechanism may have a second longitudinal axis. The first rotational axis, the second rotational axis (first longitudinal axis) and the second longitudinal axis preferably coincide. Optionally, the wheel-release mechanism may include a shaft that rotatably supports the wheel about the coinciding axes such that the wheel rotates about the shaft. The shaft may be adapted such that movement in its axial direction causes the restriction on rotation in the reverse direction imposed by the wheel forward-direction rotating mechanism to be temporarily released (e.g., as long as the shaft is disposed in an axially-displaced position relative to its axial position when the restriction is placed on rotation of the wheel in the reverse direction.)

According to one or more of the above-mentioned aspects, a screw-feeding apparatus and a screw-tightening apparatus may be designed to be more compact (shorter) in the front-rear direction.

In addition or in the alternative, a screw-feeding apparatus and a screw-tightening apparatus may be designed to be more durable with respect to dust.

In addition or in the alternative, a screw-feeding apparatus and a screw-tightening apparatus may be designed so that a screw-connecting band (screw strip) is more easily detachable (removable) in the downward direction.

Additional objects, embodiments, effects and advantages of the present teachings will be readily apparent to a person skilled in the art after reading the following description and claims in view of the appended drawings.

DETAILED DESCRIPTION OF THE EMBODIMENTS

Embodiments and modified examples of the present teachings are explained below, with reference to the drawings where appropriate.

Front, rear, up, down, left, and right in the embodiments are prescribed for the sake of convenience of explanation and may change in accordance with, for example, the circumstances of the work, the movement of the components, or the like.

Figure 1:
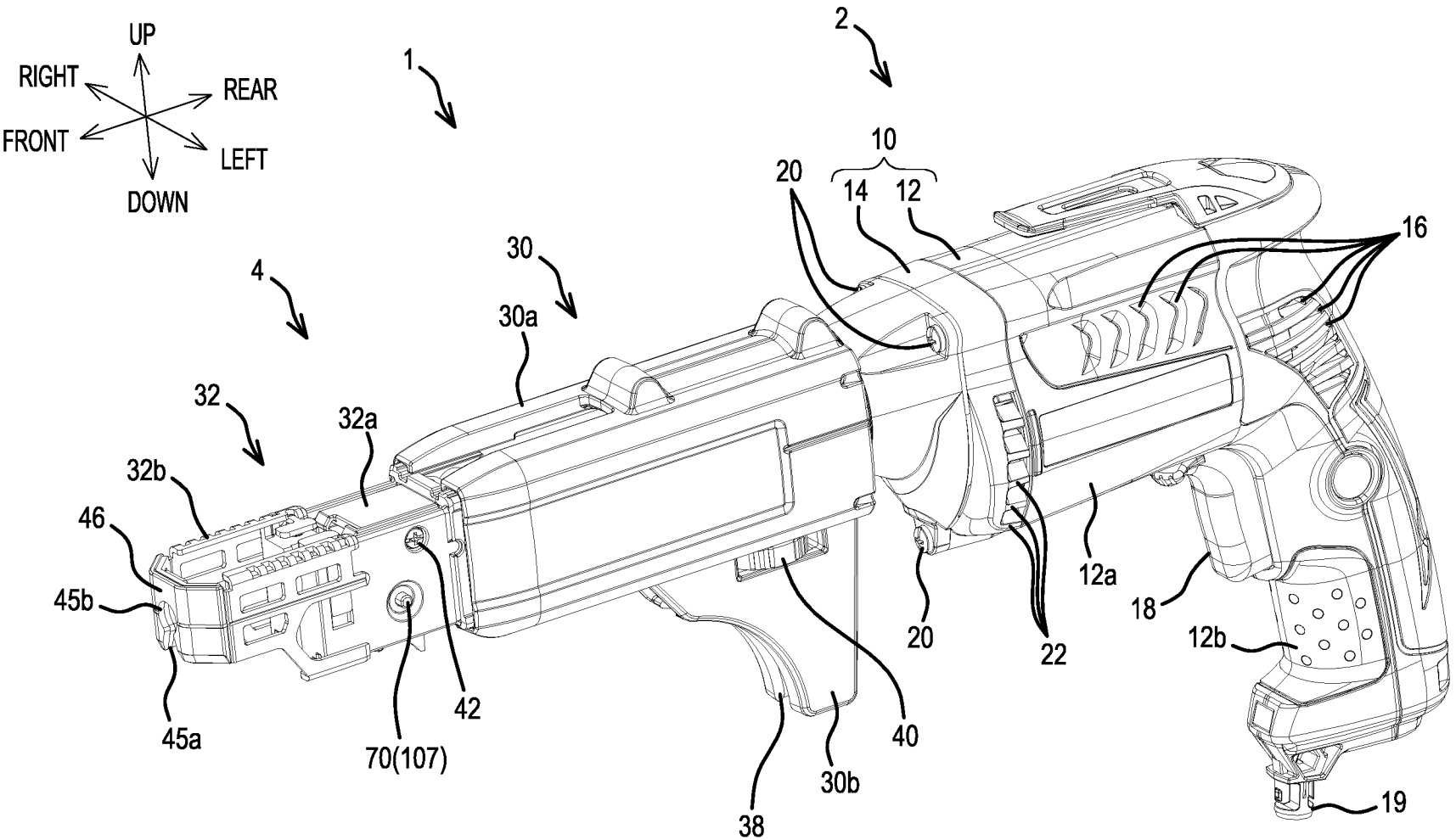
FIG. 1 is an oblique view, viewed from the front, of an autofeed screwdriver according to one non-limiting, representative embodiment of the present teachings.
Figure 2:
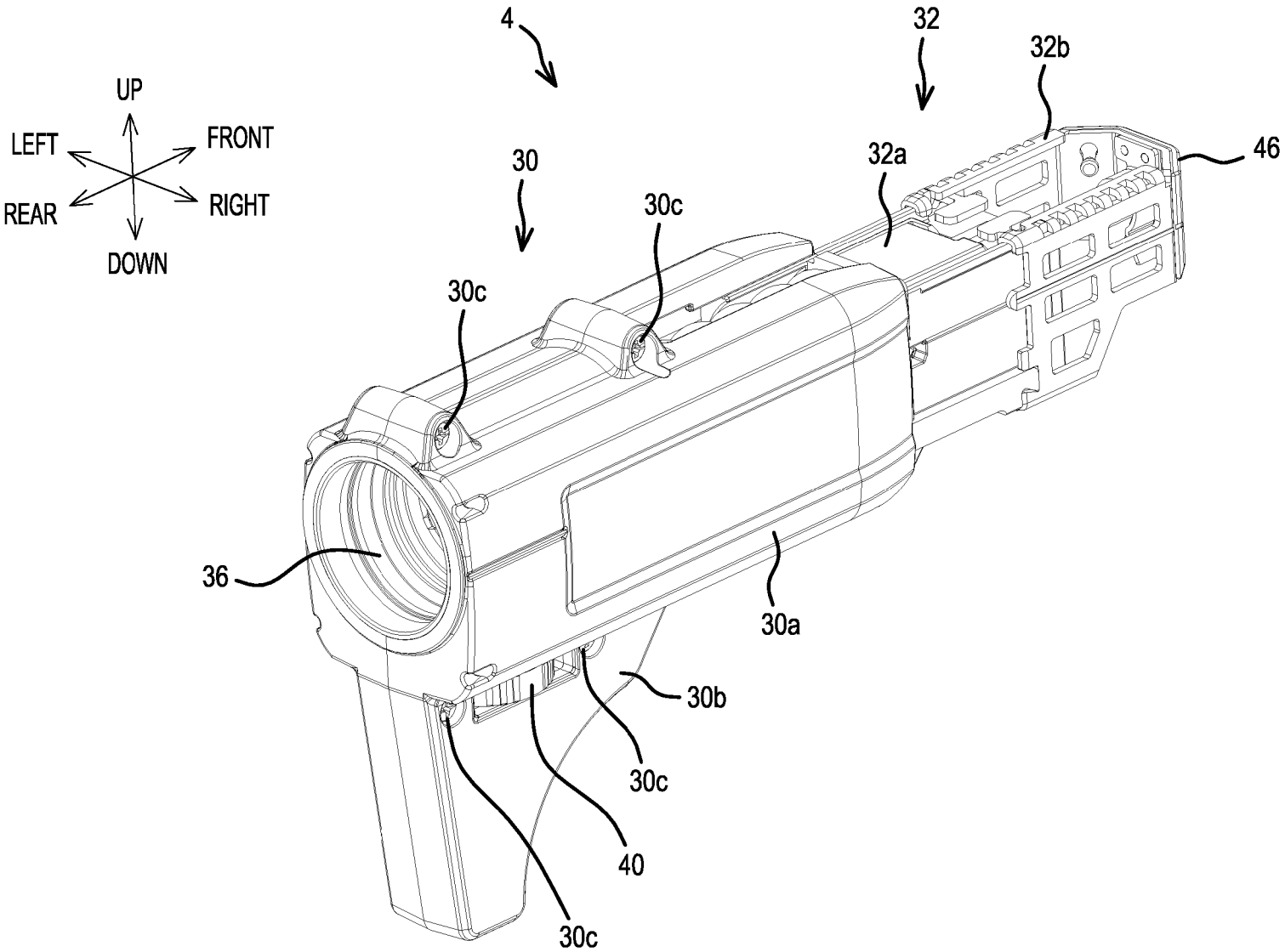
FIG. 2 is an oblique view, viewed from the rear, of the autofeed attachment shown in FIG. 1.
Figure 3:
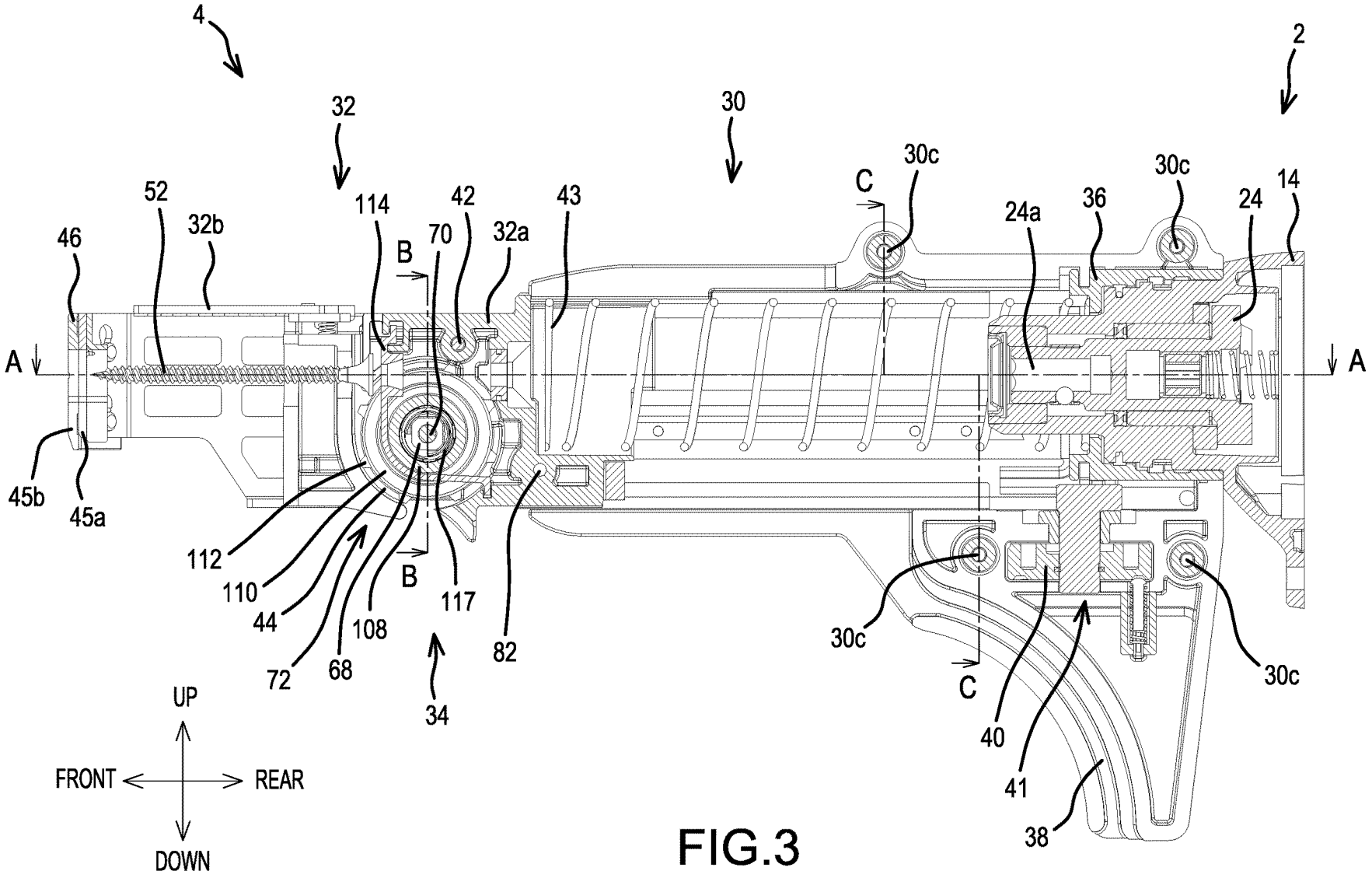
FIG. 3 is a center cross-sectional view of the autofeed attachment and a front part of a screwdriver according to FIGS. 1 and 2, showing the autofeed attachment in its expanded (protruding) state.
Figure 4:
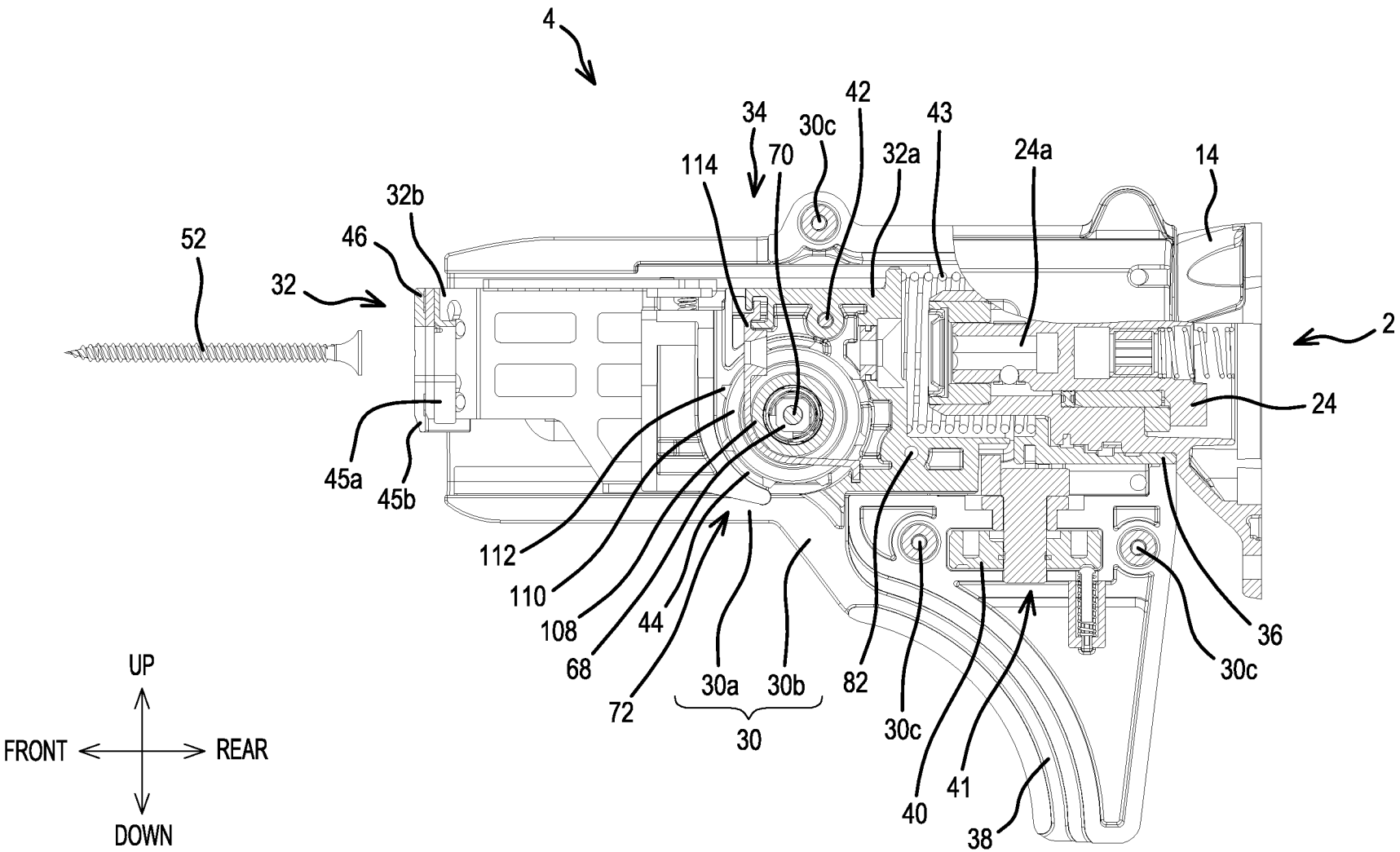
FIG. 4 is a view of the autofeed attachment in its retracted (interpolated) state.
Figure 5:
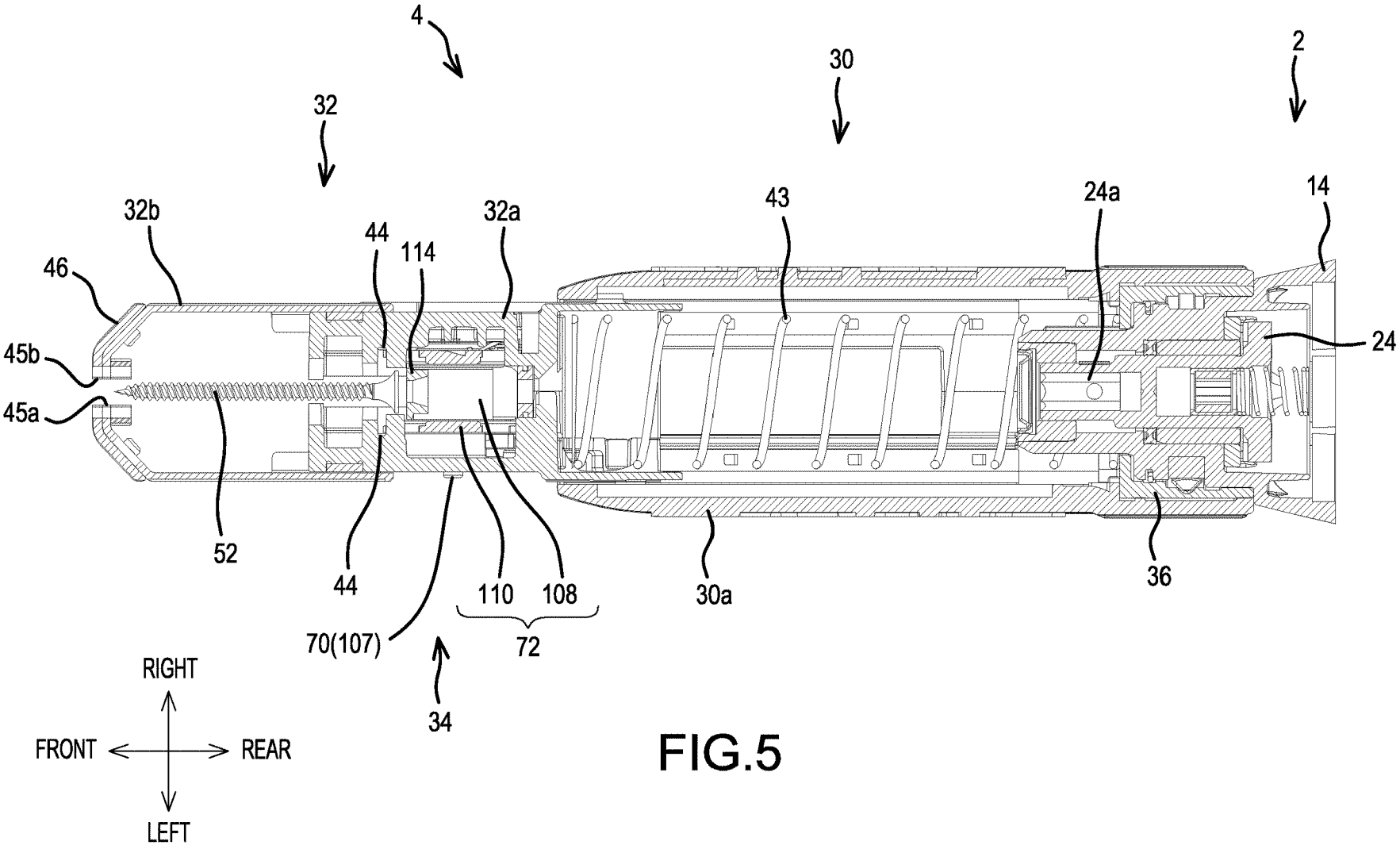
FIG. 5 is a cross-sectional view taken along line A-A in FIG. 3.
Figure 6:
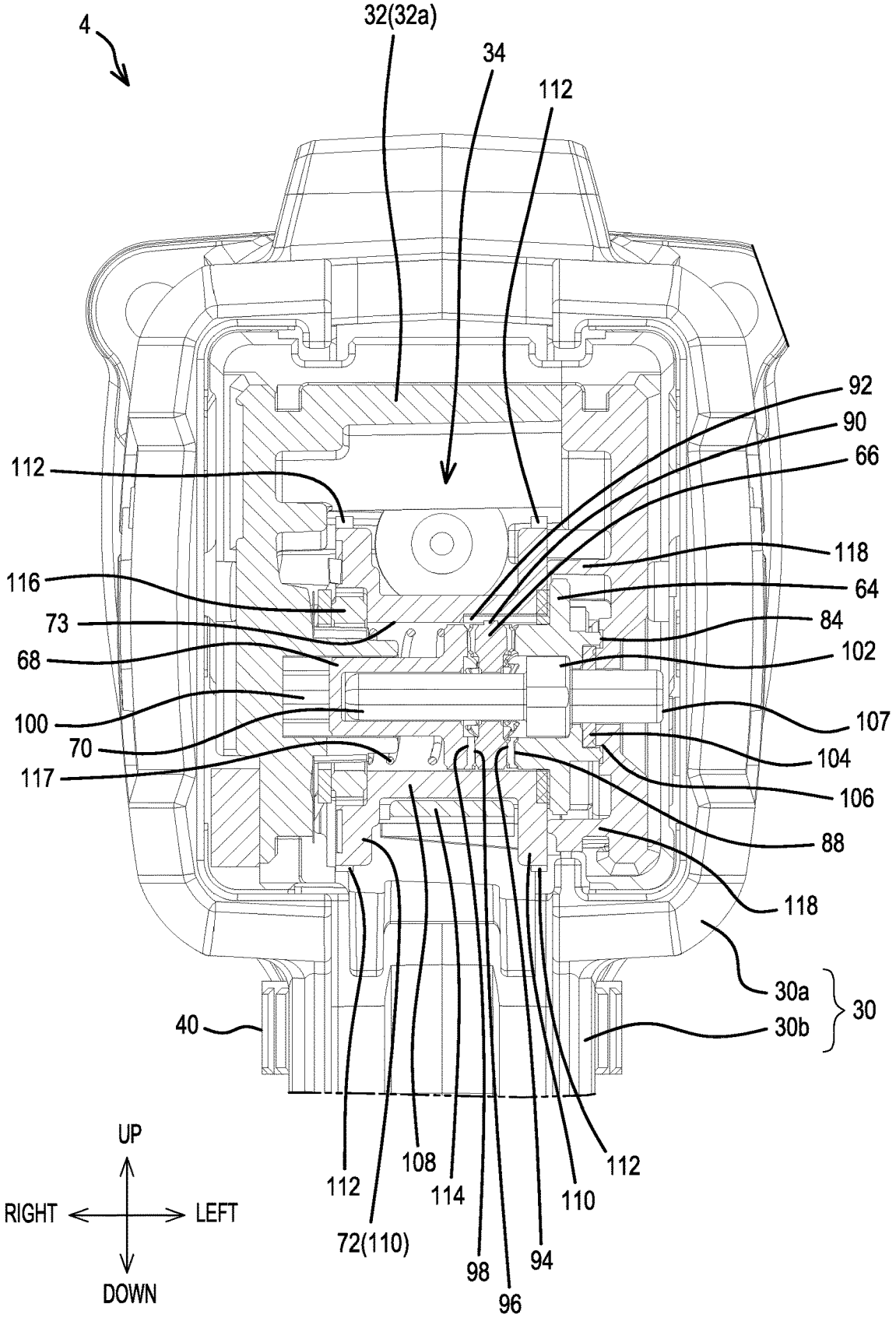
FIG. 6 is a cross-sectional view taken along line B-B in FIG. 3.
Figure 7:
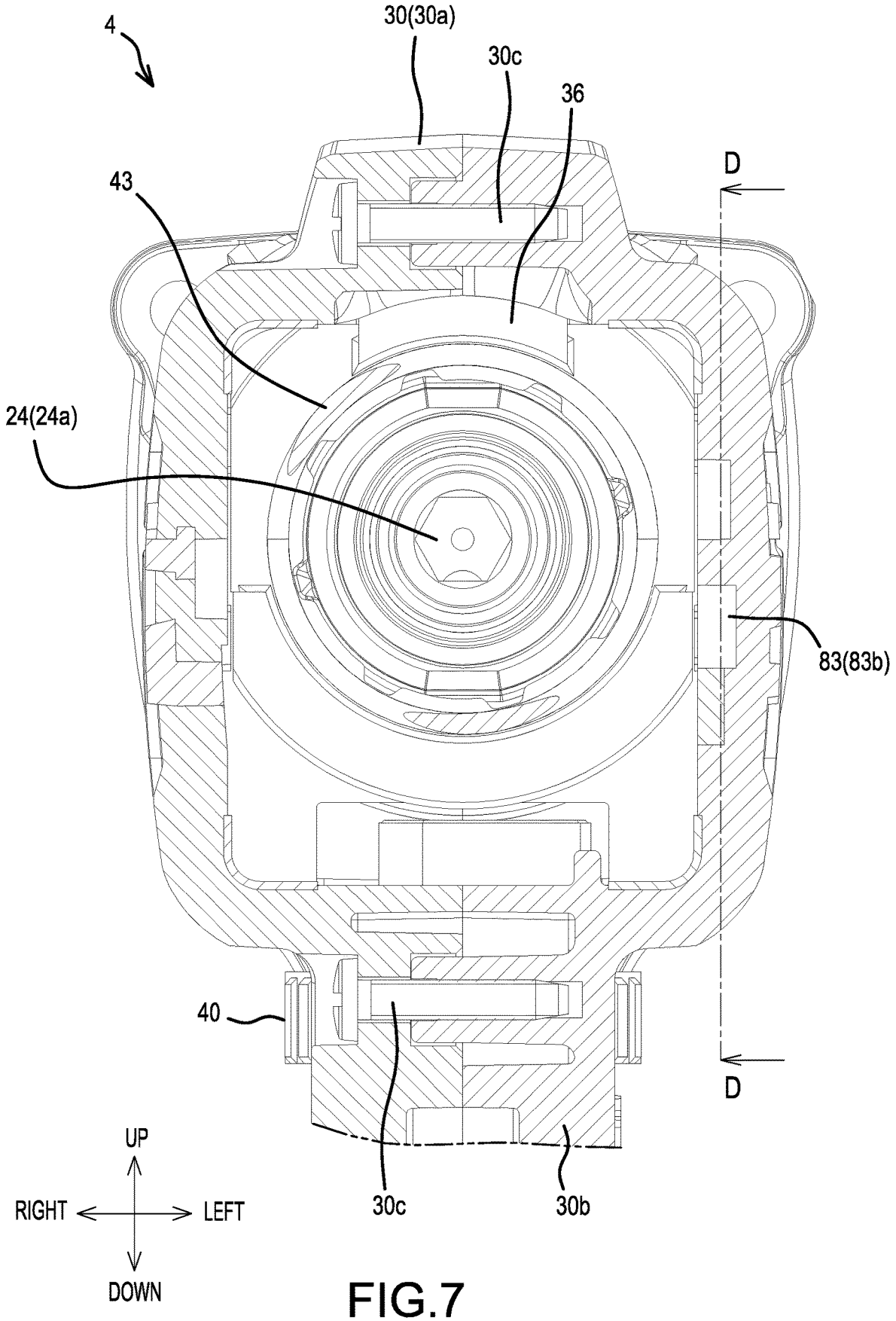
FIG. 7 is a cross-sectional view taken along line C-C in FIG. 3.
Figure 8:
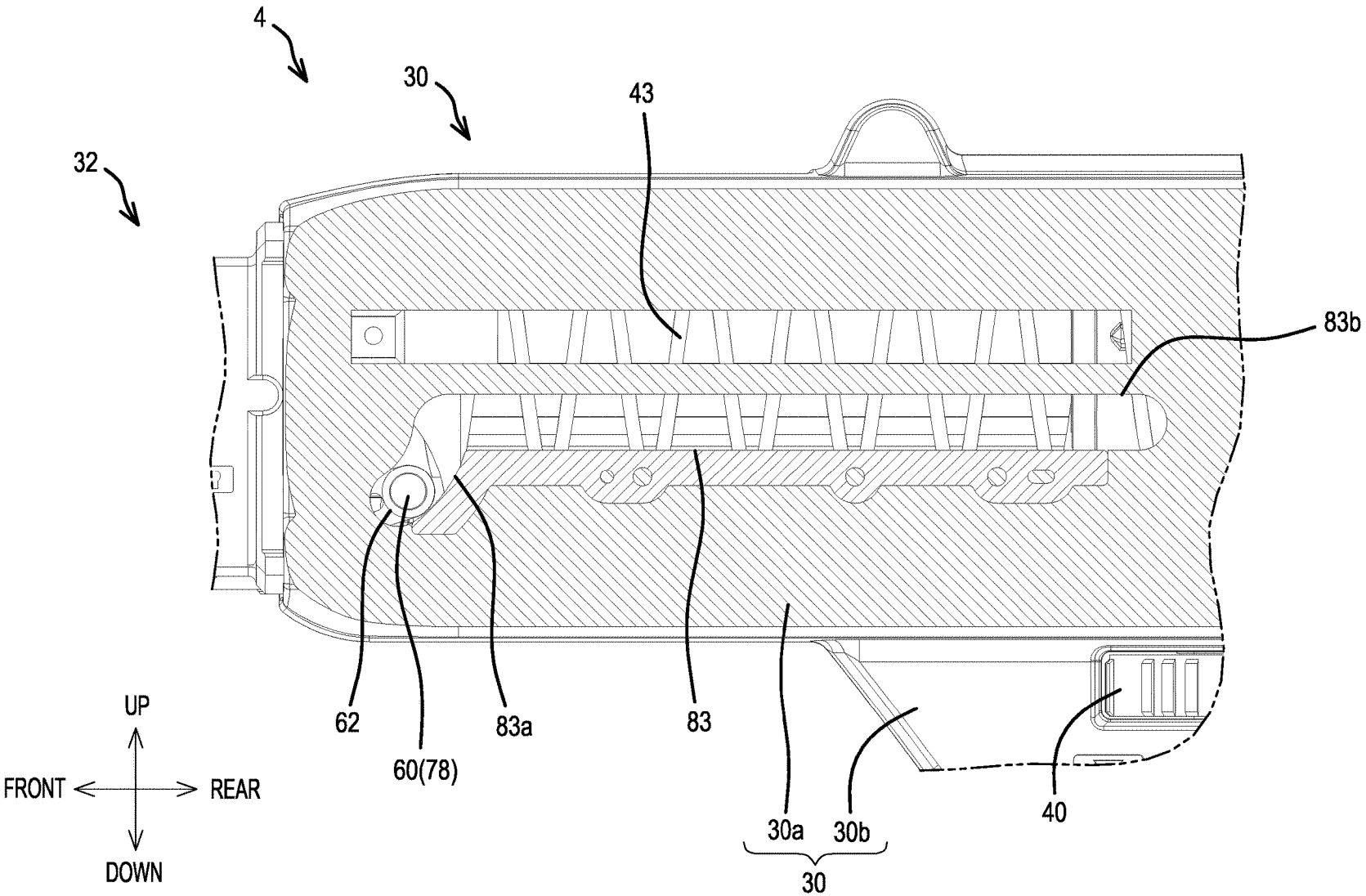
FIG. 8 is a cross-sectional view taken along line D-D in FIG. 7.

FIG. 1 is an oblique view, viewed from the front, of a rechargeable autofeed screwdriver 1, which is one non-limiting, representative example of a screw-tightening apparatus with screw-feeding (autofeed) apparatus according to the present teachings. FIG. 2 is an oblique view, viewed from the rear, of an autofeed (auto-pack) attachment 4, which is mounted on a screwdriver 2. FIG. 3 is a center cross-sectional view of the autofeed attachment 4 and a front part of the screwdriver 2. FIG. 4 shows the autofeed attachment 4 in its retracted (contracted, interpolated) state as compared to the expanded (protruding) state shown in FIG. 3. FIG. 5 is a cross-sectional view taken along line A-A in FIG. 3. FIG. 6 is a cross-sectional view taken along line B-B in FIG. 3. FIG. 7 is a cross-sectional view taken along line C-C in FIG. 3. FIG. 8 is a cross-sectional view taken along line D-D in FIG. 7.

The screwdriver 2 serves (acts) as a screw-tightening apparatus and preferably comprises a housing 10, which serves (acts) as a holding body, that directly or indirectly holds (supports) various mechanical components. It is noted that left in FIG. 3 is to the front of the autofeed screwdriver 1, up in the same drawing is above the autofeed screwdriver 1, and up in FIG. 5 is to the right of the autofeed screwdriver 1.

The housing 10 comprises: a motor housing 12, which holds a motor (not shown) that serves (acts) as a motive-power source; a speed-reducing mechanism (not shown), which includes a gear train disposed at a front side of the motor housing 12 that is rotated by a motor shaft of the motor and outputs a reduced rotational speed; and a gear housing 14, which holds a clutch mechanism that switches (engages and disengages) the transmission of torque from the gear train to a spindle 24.

The motor housing 12 has left and right halves and comprises: a motor-housing main body 12*a* that has a tube shape and extends forward and rearward and in which a motor is disposed. Rearward thereof, a grip 12*b* has a tube shape and extends downward from a lower part of the motor-housing main body 12*a*. Air-suction ports 16 are formed in one or both side surfaces of the motor-housing main body 12*a*. A trigger 18 is partially exposed at a front-upper part of the grip 12*b* and enables the switch state of a switch (not shown) for controlling the motor to be changed by pulling (squeezing) the trigger 18. A cord-connection part 19 for a power cord (not shown) that supplies electric current to the motor is provided on (at) a lower end of the grip 12*b*.

The gear housing 14 has a tapered-tube shape and is mounted on a front opening of the motor-housing main body 12*a* by a plurality of screws 20 being passed through a rear part of the gear housing 14 in the front-rear direction. Air-exhaust ports 22 are provided on one or both side surfaces of the gear housing 14. The above-mentioned spindle 24, which serves (acts) as an output part for driving (tightening) screws, is held inside the front part of the gear housing 14. A bit-mounting hole 24*a* (FIGS. 3 and 7) is formed in the front end of the spindle 24 in the front-rear direction and is provided for mounting a not-shown tool accessory (e.g., a screwdriving bit). The spindle 24 is connected (operably coupled) to the speed-reducing mechanism and the clutch mechanism and is thereby rotationally driven by the motor in accordance with the switch state of the switch (actuated by the trigger 18) and the engaged/disengaged state of the clutch mechanism.

The autofeed attachment 4, which serves (acts) as a screw-feeding apparatus, comprises: a base casing 30; a feeder casing 32, which is disposed in the interior of and forward of the front part of the base casing 30; and a screw strip feeding mechanism 34, which is disposed inside the feeder casing 32.

The base casing 30 comprises: a base-casing main body 30*a*, which extends in the front-rear direction and has a square columnar shape; and a screw strip guide 30*b*, which extends downward from the rear part of the base-casing main body 30*a* in a tapered shape. The base casing 30 has left and right halves, which are joined to one another by screws 30*c*.

A tubular adapter 36 is fitted in a rear opening of the base-casing main body 30*a*. The inner surface of the adapter 36 has a circular-tubular shape configured such that it at least partially conforms to the outer surface of the front end of the screwdriver 2. The outer surface of the adapter 36 is formed such that it at least partially conforms to an inner surface of the rear part of the base casing 30. The adapter 36 receives (holds) the front end of the screwdriver 2 to detachably fix the base casing 30 to (on) the screwdriver 2. When fixed in such a manner, the bit of the screwdriver 2 is located in (extends into) the interior of the autofeed attachment 4.

In the interior of the screw strip guide 30*b*, an arcuate lower-guide groove 38 is formed such that the center of the groove 38 is located forward of the lower end of the motor-housing main body 12*a*. A discoidal (disc-shaped) depth-adjusting dial 40 is provided in an upper portion of the screw strip guide 30*b*, which is upward of the lower-guide groove 38. The axial direction (rotational axis) of the depth-adjusting dial 40 is aligned with (extends in) the up-down direction. As shown in FIGS. 1 and 7, the depth-adjusting dial 40 is exposed on the left and right sides and such that the user can manually rotate the depth-adjusting dial 40. A depth-adjusting mechanism 41 (FIGS. 4 and 5) is connected to the depth-adjusting dial 40. The depth-adjusting mechanism 41 finely adjusts the front-rear position of the adapter 36 in accordance with the rotational position of the depth-adjusting dial 40 and thereby finely adjusts the front-rear position of the autofeed attachment 4 (excluding the adapter 36) with respect to the screwdriver 2 and the adapter 36.

The feeder casing 32 comprises a stopper base 32*b* mounted on a front end of a feeder box 32*a*.

The feeder box 32*a* has left and right halves. An open-cover, box-shaped right part and a cover-shaped left part are joined together by a screw 42. The feeder box 32*a* is provided so as to be movable in the front-rear direction within (relative to) the base casing 30 by superimposing one or more front-rear-extending rail(s), which is (are) formed on one of the inner surface of the base casing 30 and the outer surface of the feeder box part 32*a*, on one or more corresponding front-rear-extending groove(s), which is (are) formed on the other. A coil spring 43 extends in the front-rear direction and serves (acts) as an elastic body (urging member). The coil spring 43 extends between the rear part of the feeder box 32*a* and the front part of the adapter 36 within the base-casing main body 30*a*, as shown in FIGS. 3-5. Thus, the feeder casing 32 is mounted, such that it is movable in the front-rear direction, on (relative to) the base casing 30 with the feeder casing 32 being biased (urged) forward (relative to the base casing 30) by the coil spring 43.

In addition, the feeder box 32*a* has an open part, which is open from a center part of a front surface to a front part of a lower surface, and has J-shaped upper-guide grooves 44 on both sides of the front part of the feeder box 32*a*. The lower parts of the J-shaped upper-guide grooves are arcuate in a side view and the upper parts of the J-shaped upper-guide grooves extend (straight) in the up-down direction in a side view.

The stopper base 32*b* has a box shape, which is open at the top, bottom, and rear, and, at its rear part, receives the front part of the feeder box 32*a*. A screw pass-through slit 45*a* is formed in the front surface of the stopper base 32*b* and extends from the center part to the lower part. A cap 46 is made of an elastic body (e.g., rubber or other elastomer) and likewise has a screw pass-through slit 45*b*. The cap 46 is fitted onto the front side of the front surface of the stopper base 32*b*. The stopper base 32*b* may be made available in differing lengths in the front-rear direction, in addition to the one shown in the drawings, so that it can be exchanged in accordance with the length of the screws 52 on a screw strip 50. In the alternative, the stopper base 32*b* may be configured such that it is linearly movable relative to the feeder box 32*a*, in order to adjust the front-rear length of the interior of the stopper base 32*b* (i.e. relative to the feeder box 32*a*). After the front-rear length is set, it may then be locked in the set axial position during operation of the autofeed mechanism 4.

In the screw strip 50, as partly shown in FIG. 10, the screws 52 pass through holes (e.g., 50 holes) formed in a connecting strip 54, which is made of a synthetic resin or other type of flexible plastic, such that the screws 52 are aligned and equispaced in the longitudinal direction, the heads of the screws 52 cover the holes on one side of the connecting strip 54 and the screw threads of the screws 52 pass through the holes and are disposed on the other side of the connecting strip 54. It is noted that only one of the screws 52 is shown in FIGS. 3-5 and 10 for simplicity and clarity of illustration.

Notches (cutouts, through-holes) 56 are disposed at (formed in, penetrate through) both longitudinal sides of the connecting strip 54. The notches 56 are disposed at a pitch or spacing that is the same as the spacing of the holes in the connecting strip 54 for the screws 52 (i.e., at the same pitch/spacing of the screws 52). Each of the notches 56 is disposed midway between the holes of adjacent screws 52 in the longitudinal direction of the connecting strip 54.

The screw strip feeding mechanism 34 is disposed inside the feeder box 32*a* as shown in FIGS. 3-6.

Figure 9:
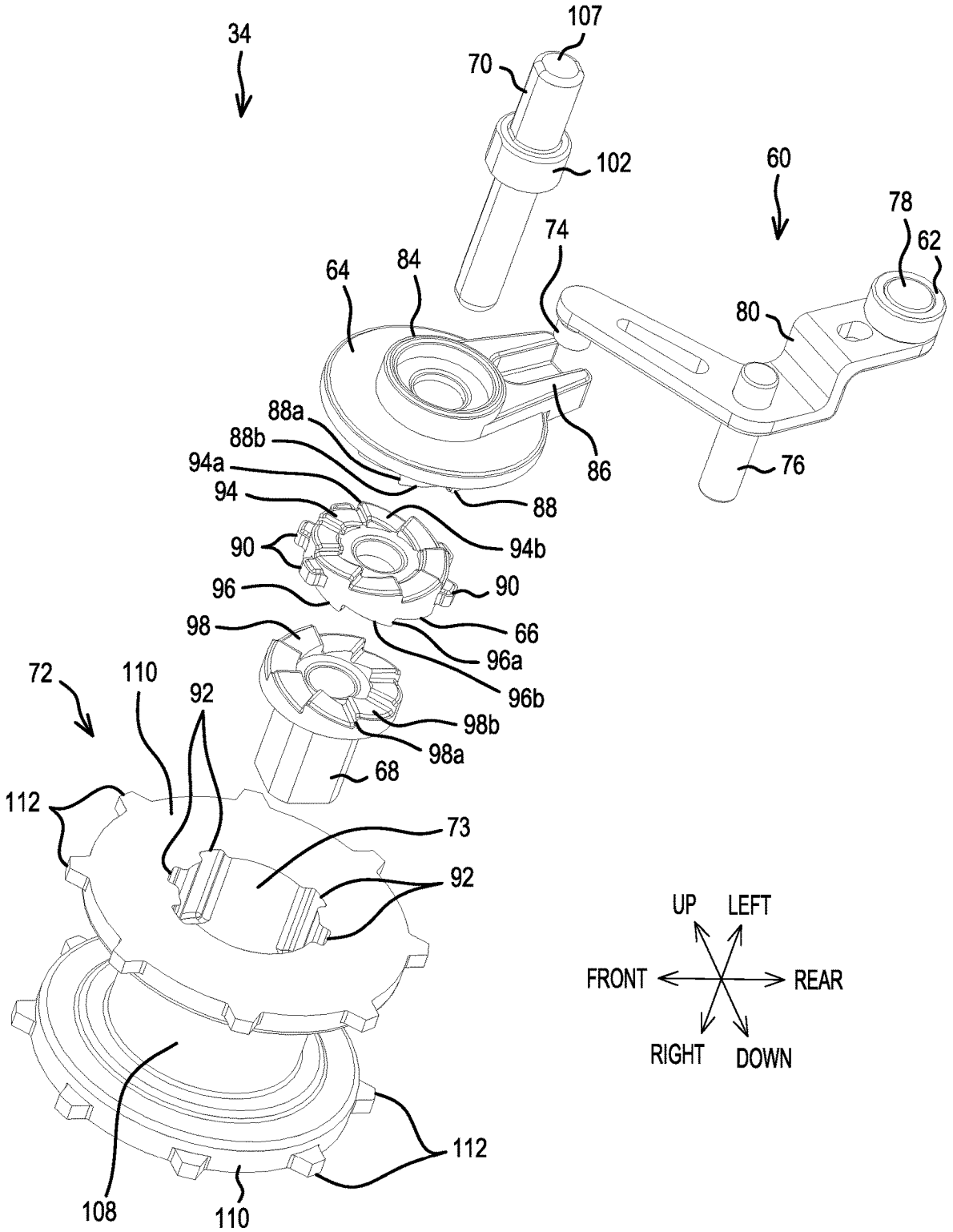
FIG. 9 is an exploded oblique view of a screw strip feeding mechanism disposed in the autofeed attachment shown in FIG. 2.

Referring now to FIGS. 9-11, the screw strip feeding mechanism 34 comprises: a lever 60, which has a V shape in a side view; a ring-shaped (annular) sleeve 62, which is disposed on a rear end of the lever 60; a donut-shaped (annular) first cam 64, which is disposed on the front side of the lever 60; a donut-shaped (annular) second cam 66, which is disposed on the right side of the first cam 64; a tube-shaped (annular) third cam 68, which is disposed on the right side of the second cam 66; a shaft 70, which extends in the left-right direction and is inserted through the center holes of the first cam 64, the second cam 66 and the third cam 68; and a bobbin-shaped wheel 72, which also has a center hole (central axial through opening or central through opening) 73 extending in the left-right direction and receives (holds) at least the second cam 66 and a portion of the third cam 68. The right side of the first cam 64 (in particular, first teeth 88) is also disposed within the center hole of the wheel 72 (see FIG. 6).

The lever 60 comprises: a front pin 74, which projects rightward from the right part of the front end of the lever 60; a center pin 76, which projects leftward and rightward from a central corner of the lever 60; a rear pin 78, which projects leftward from a leftward portion of a rear end of the lever 60; and a bent part 80, which is formed between the center pin 76 and the rear pin 78.

The center pin 76 is inserted into a hole 82 (see FIG. 3), which extends in the left-right direction and is provided in the feeder casing 32, and is rotatably supported in the hole 82. Thus, the lever 60 is pivotable about the center pin 76. More specifically, the lever 60 is caused to pivot by movement of the feeder case 32 relative to the base casing 30 (i.e. when a screw 52 is being loaded into the stopper box 32*b*) and by the rear pin 78 thereby being caused to travel along a groove-shaped lever guide 83.

That is, the sleeve 62 is inserted (placed) onto the rear pin 78 so as to be rotatable relative to the rear pin 78. The sleeve 62 and the rear pin 78 are inserted (disposed) within the groove-shaped lever guide 83, which is formed (defined) in (on) an inner surface of the left part of the base-casing main body 30*a*, as shown in FIGS. 7 and 8. A lever-guide front part 83*a*, which is the front (forward) portion of the lever guide 83, extends generally in the up-down direction (more specifically, in a diagonal direction from a lower front side to an upper rear side—see FIG. 8). A lever-guide main body 83*b*, which is another guide portion of the lever guide 83 for guiding movement of the rear pin 78, extends straight rearward in the front-rear direction from the intersection with the lever-guide front part 83*a*.

The portion of the lever 60 that is located forward of the bent part 80 in the front-rear direction is also located more rightward of the portion of the lever 60 rearward thereof in the front-rear direction. In other words, the bent portion 80 bends to the right so that the rear pin 78 may engage in the groove-shaped lever guide 83 defined in the base-casing main body 30*a* and the front pin 74 may engage in a groove part 86 of the first cam 64, which is disposed rightward (inward) of the base-casing main body 30*a*.

The outer dimension (periphery, diameter) of the first cam 64 is larger than the outer dimension (periphery, diameter) of the center hole of the wheel 72. Therefore, the leftward portion of the first cam 64 is disposed outside of the wheel 72 and the rightward facing surface of the first cam 64, which is radially outward of (radially surrounds) first teeth 88, abuts the left-facing surface of the leftward flange 110 of the wheel 72.

A ring-shaped (annular) rib (boss) 84 projects leftward around the center hole on the left-facing surface of the first cam 64. The groove part 86 is defined (disposed) on a rear side of the rib 84. The groove part 86 extends in the front-rear direction and is formed (defined) by two parallel ribs that extend rearward with the left-facing surface of the first cam 64 interposed therebetween. As was noted above, the front pin 74 of the lever 60 is inserted in the groove part 86 while being movable in the front-rear direction when the lever 60 is pivoted about the center pin 76 that is disposed in the hole 82 of the feeder box 32*a*.

In addition, the above-mentioned first teeth (e.g., 8 teeth) 88 are arranged around the center hole on the right-facing surface of the first cam 64. Each tooth of the first teeth 88 comprises a first steeply inclined surface 88*a* (the surface in the left-right direction) and a first gently inclined surface 88*b*. Each first steeply inclined surface 88*a* is disposed on the counterclockwise side, viewed from the right, of the first gently inclined surface 88*b* of the same tooth.

The second cam 66 has five protrusions (tabs) 90, which protrude radially outward from the circular-tubular outer surface, namely three protrusions 90 on an upper part and two protrusions 90 on a lower part. The protrusions 90 are arranged such that they do not have rotational symmetry as a whole. Furthermore, five recessed grooves (slots) 92 are formed in (around) the center hole of the wheel 72 so as to extend in the left-right direction and are arranged at complementary (corresponding) locations to the protrusions 90. Because the protrusions 90 and the recessed grooves 92 are disposed (arranged) in a rotationally non-symmetric manner, it is possible to prevent the second cam 66 from being disposed (placed, installed) inside the wheel 72 in the wrong orientation. That is, the protrusions 90 prevent the surface of the second cam 66 having second teeth 94 (see below) from being mistakenly placed facing the right side (i.e. facing away from the first teeth 88) instead of facing the left side (i.e. facing toward the first teeth 88).

As mentioned above, second teeth 94, which are shaped similar to the first teeth 88, are formed on the left-facing surface of the second cam 66. Second steeply inclined surfaces 94*a* of the second teeth 94 are disposed on the counterclockwise side, viewed from the left, of second gently inclined surfaces 94*b* of the same tooth.

Furthermore, third teeth 96, which are also shaped similar to the first teeth 88 and the second teeth 94, are formed on the right-facing surface of the second cam 66. Third steeply inclined surfaces 96*a* of the third teeth 96 are disposed on the clockwise side, viewed from the right, of third gently inclined surfaces 96*b* of the same tooth.

The leftward part of the third cam 68 has a donut shape, and the rightward part of the third cam 68 has a bottomed tube (blind hole) shape that is narrower (smaller diameter) than the leftward part (see FIG. 6). Fourth teeth 98, which are shaped similar to the third teeth 96, are formed on the left-facing surface of the third cam 68. Fourth steeply inclined surfaces 98*a* of the fourth teeth 98 are disposed on the clockwise side, viewed from the left, of fourth gently inclined surfaces 98*b* of the same tooth.

The rightward part of the third cam 68 is inserted, so as to be movable in the left-right direction, in a cam-receiving part 100 (see FIG. 6), which extends in the left-right direction and is formed such that it protrudes leftward in a tube shape from an inner surface of the right part of the feeder box 32*a*. It is noted that at least a portion of the outer surface (contour) of the rightward extension of the third cam 68 preferably has a non-circular, e.g., polygonal, cross-section and at least a portion of the inner surface (contour)

of the cam-receiving part 100 also preferably has a corresponding or complementary non-circular, e.g., polygonal, cross-section, such that the outer surface of the third cam 68 mates or engages with the inner surface of the cam-receiving part 100 in an interlocking (form fit) manner, thereby blocking or preventing rotation of the third cam 68 about its central longitudinal axis.

The shaft 70 has a circular-column shape and, at a center part thereof, comprises a large-diameter part 102, which is thicker (larger diameter) than other portions of the shaft 70. Optionally, the outer surface (contour) of at least the rightward extension of the shaft 70 also preferably has a non-circular, e.g., partially flat, cross-section and at least a portion of the inner surface (contour) of the third cam 68 also preferably has a corresponding or complementary non-circular, e.g., partially flat, cross-section, such that the outer surface of the shaft 70 mates or engages with the inner surface of the third cam 68 in an interlocking (form fit) manner, thereby blocking or preventing rotation of the shaft 70 about its central longitudinal axis. In this case, the reverse button 107 will not rotate when the wheel 72 advances the screw strip 50. However, the shaft 70 preferably has a substantially circular cylindrical outer surface to support (permit) rotation of the first cam 64 and the second cam 66 about the shaft 70.

Figure 11A:
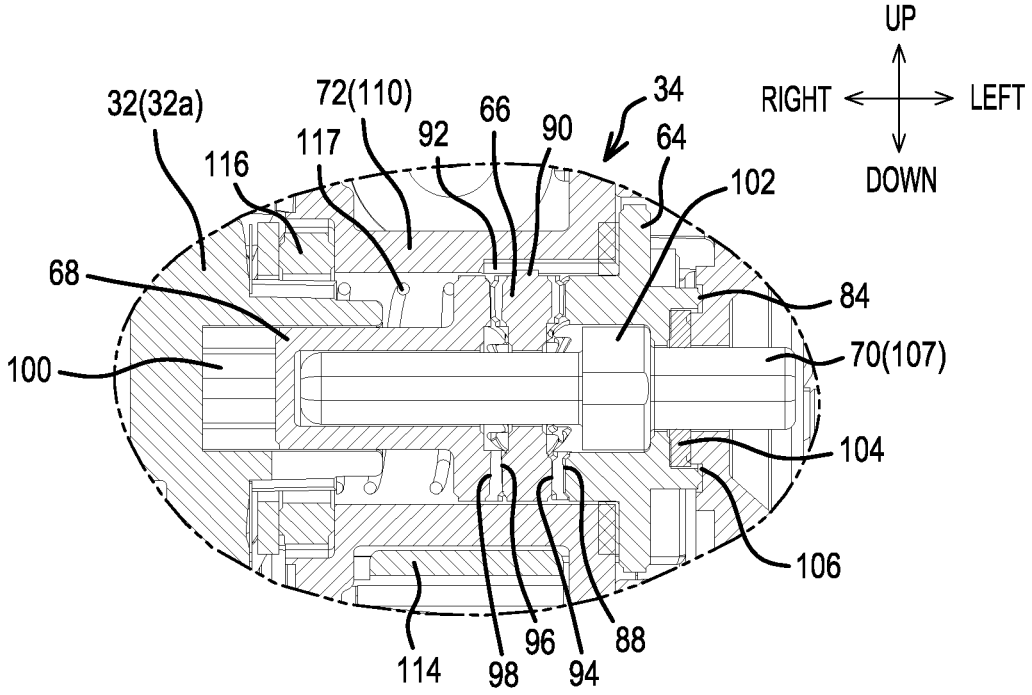
FIGS. 11A-11D are schematic drawings concerning the screw strip feeding mechanism shown in FIG. 9 when it is operated to permit reverse rotation of the wheel.

As shown in FIG. 11A, the portion of the shaft 70 that is rightward of the large-diameter part 102 is inserted (held) in the center blind hole of the third cam 68 and the center though hole of the second cam 66. On the other hand, the large-diameter part 102 and the portion of the shaft 70 leftward of the large-diameter part 102 are inserted (held) in the center through hole of the first cam 64. The first cam 64 is positioned (held) in the left-right direction by a felt ring 104, by an inner surface of the left part of the feeder box 32*a* and by the large-diameter part 102. A ring-shaped small-groove 106, which receives the rib (boss) 84 of the first cam 64, is formed on the inner surface of the left part of the feeder box 32*a*.

The left-end part of the shaft 70 passes through a hole formed in the left part of the feeder box 32*a* and constitutes a reverse button 107, which is exposed externally (see FIG. 5) so that the user may press it to push the third cam 68 rightward so that the second cam 66 disengages from the first cam 64 and the third cam 68, thereby enabling rotation of the wheel 72 in the reverse direction, as will be further discussed below.

The wheel 72 comprises a discoidal (disc-shaped) flange 110 on both the left and right sides of a central circular-tubular part 108. The spacing of the flanges 110 is approximately identical to the width of the connecting strip 54, more specifically slightly narrower than the width of the connecting strip 54. Radially-outwardly-protruding feed teeth 112 are disposed (arranged) on the circular-tubular surface of each flange 110 such that the feed teeth 112 are equispaced in the circumferential direction.

As shown in FIGS. 3, 4 and 6, the wheel 72 is held and positioned rearward of the upper-guide grooves 44 by a band 114, which makes contact with or is proximate to a front-lower part of the circular-tubular part 108. An upper-end portion of the band 114 is attached at the upper part of the feeder box 32*a* and is fixed to the rear sides of the upper guide grooves 44. A lower end portion of the band 114 is fixed to a lower-rear part of the feeder box 32*a*. A hole, through which the bit passes, is formed in the upper portion of the band 114. In addition, a bearing 116 (see FIG. 6) rotatably supports the wheel 72 and is disposed between the right part of the center hole of the wheel 72 and the tube-shaped outer surface of the cam-receiving part 100.

Furthermore, a spring 117, which serves (acts) as an elastic body (urging member), extends between the right side of the bearing 116 and the third cam 68 (more specifically, the right-facing surface of the donut-shaped part on the left side of the third cam 68). The spring 117 presses (biases, urges) the teeth of the cams 64, 66, 68 into contact (engagement) when the user is not pressing the reverse button 107.

The left-surface side of the wheel 72 is positioned (held) in the left-right direction by the right-facing surface of the first cam 64 (the flat portion of the first cam 64 that radially surrounds the first teeth 88) and by upper and lower positioning ribs 118, which extend rightward from the inner surface of the left part of the feeder box 32*a*.

The third cam 68 (or at least the leftward portion thereof), the second cam 66, the right-end part of the first cam 64, and the rightward part of the shaft 70 are disposed inside the center hole of the wheel 72. Among these three cams 64, 66, 68, only the second cam 66 is coupled to (interlocked with) the wheel 72 by engagement (placement) of the protrusions 90 on the second cam 66 in the recessed grooves 92 within the wheel 72. In addition, the third cam 68, the second cam 66, and the shaft 70 are movable in the left-right direction (against the biasing force of spring 117). The first cam 64 is preferably not movable in the left-right direction. As was noted above, the first cam 64 and the second cam 66 are rotatably supported by the shaft 70, whereas the third cam 68 is not rotatable owing to its interlocked engagement with the cam-receiving part 100 defined on (fixedly extending from) the inner surface of the feeder box 32*a*.

The lever 60, the first cam 64, the second cam 66, and the third cam 68 (along with the lever guide 83) are components of one representative, non-limiting embodiment of a wheel forward-direction rotating mechanism according to the present teachings. In addition, the shaft 70 and the spring 117 are components of one representative, non-limiting embodiment of a wheel-release mechanism according to the present teachings.

An example of the operation of the autofeed screwdriver 1 configured in this manner is explained below, with reference principally to FIGS. 10 and 11.

Figure 11B:
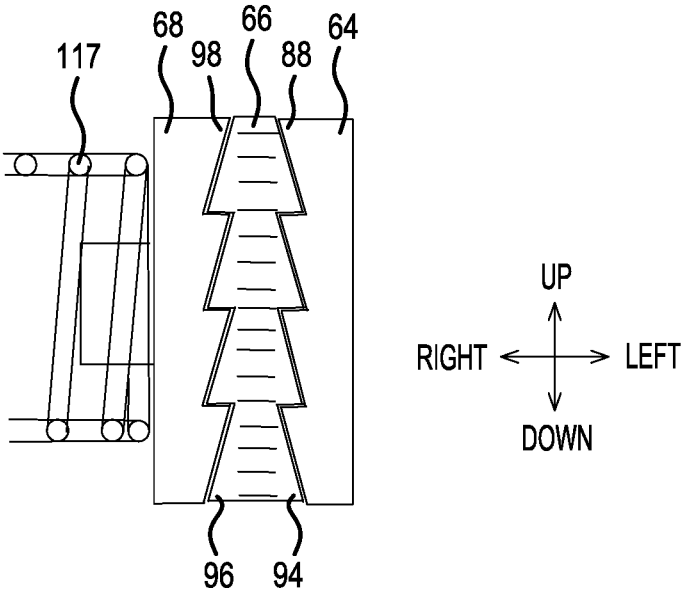

A user passes an end part of the connecting strip 54 of the screw strip 50, with the screw threads of the screws 52 facing forward, from the lower end to the upper end of the lower-guide-groove 38 of the base casing 30 while the autofeed attachment 4 mounted on the screwdriver 2 is in its extended state (FIG. 3), and then further inserts the connecting strip 54 into the lower end parts of the upper guide grooves 44 of the feeder casing 32. It is noted that, as shown in FIGS. 11A and 11B, when setting (inserting) the screw strip 50 and during screw tightening, the reverse button 107 of the shaft 70 is not pressed such that the third cam 68 and the second cam 66 are biased toward the first cam 64 by the spring 117. Consequently, in this state, the first teeth 88 contact and mesh with the second teeth 94, and the third teeth 96 contact and mesh with the fourth teeth 98.

Figure 10A:
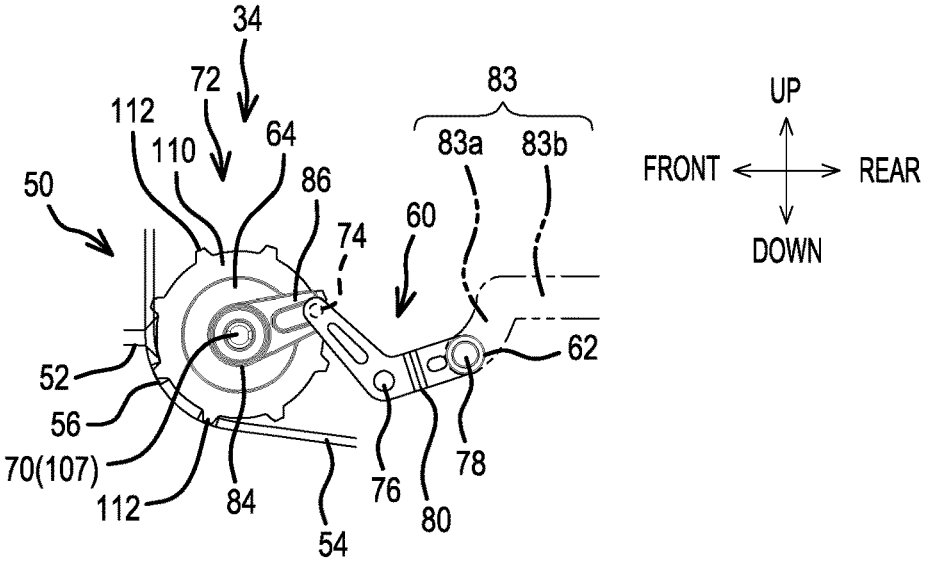
FIGS. 10A-10F are schematic drawings concerning a screw-feeding operation of the screw strip feeding mechanism shown in FIG. 9.
Figure 10B:
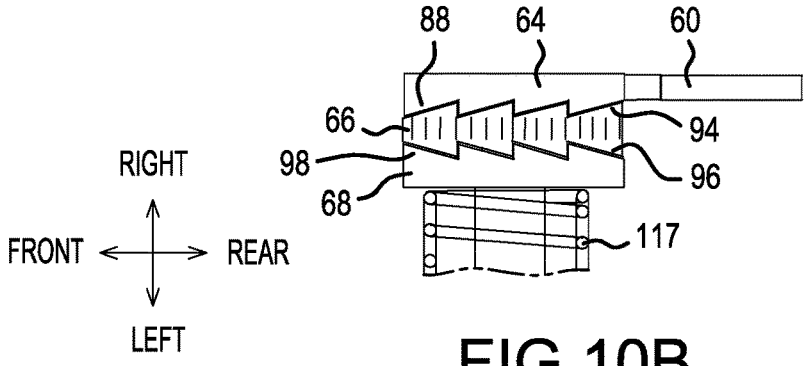

While the screw strip 50 is being inserted into the feeder box 32*a*, the first cam 64 is held in a fixed rotational position by the engagement of the front pin 74 of the lever 80 in the groove part 86 of the first cam 64. As shown in FIGS. 10A and 10B, even though the first cam 64 and the third cam 68 are not rotatable in this state, the wheel 72 is rotatable in the clockwise direction, viewed from the left side; that is, it is rotatable in the forward direction, but rotation in the reverse direction is restricted (blocked). More specifically, when the wheel 72 is rotated in the forward direction while the first cam 64 is not rotatable (i.e. by inserting the screw strip 50 into the feeder box 32*a* so that the notches 56 engage the feed teeth 112 and cause the wheel 72 to rotate), the second steeply inclined surfaces 94*a* of the second teeth 94 of the second cam 66, which is connected to the wheel 72, slide (slip) over the first gently inclined surfaces 88*b* of the first teeth 88 of the first cam 64 and successively separate from the first steeply inclined surfaces 88*a*. In addition, the third steeply inclined surfaces 96*a* of the third teeth 96 of the second cam 66 slide over the fourth gently inclined surfaces 98*b* of the fourth teeth 98 of the third cam 68 and successively separate from the fourth steeply inclined surfaces 98*a*. On the other hand, rotation of the wheel 72 in the reverse direction is restricted (blocked) when the first cam 64 and the third cam 68 are not rotatable, because the second steeply inclined surfaces 94*a* of the second teeth 94 of the second cam 66, which are connected to the wheel 72, engage the first steeply inclined surfaces 88*a* of the non-rotatable first cam 64. In addition, the third steeply inclined surfaces 96*a* of the third teeth 96 of the second cam 66 engage the fourth steeply inclined surfaces 98*a* of the non-rotatable third cam 68, which also restricts (blocks) rotation of the wheel 72 in the reverse direction.

As was noted above, when the connecting strip 54 of the screw strip 50 is inserted into the lower end portion of the upper guide grooves 44, it contacts the flanges 110 (more specifically, the feed teeth 112 thereof) of the wheel 72, thereby rotating the wheel 72 in the forward direction. By rotating the wheel 72 in the forward direction, the screw strip 50 is loaded into operating position in the feeder box 32*a* because the front-lower portions of the left and right feed teeth 112 enter and engage the corresponding notches 56 of the upper-end part of the screw strip 50. The left and right feed teeth 112 thus transmit the rotational movement of the wheel 72 to the screw strip 50, thereby advancing the screw strip 50 upward when the wheel 72 rotates in the forward direction (i.e. in the direction that loads another screw 52 into the stopper base 32*b* so that the screw 52 may be driven into the workpiece or work area by the bit).

When the autofeed attachment 4 is in the (its) extended state, the rear pin 78 of the lever 60 is located at the lower end of the lever-guide front part 83*a*, and the front pin 74 and the groove part 86 of the first cam 64 are located upward, as shown in FIGS. 8, 10A and 10B. At this time, the screw 52 is located below the position where it can be driven into the workpiece or work area, i.e. the screw 52 is not yet "loaded" into the stopper base 32*b* to be driven by the bit.

With the autofeed attachment 4 in the (its) extended state, the user places the cap 46 on the area (work area) at which a screw 52 is to be screwed into the workpiece and then pushes the screwdriver 2 forward.

This pushing causes the base casing 30 to advance, against the bias force of the coil spring 43, relative to the feeder casing 32, thereby contracting the autofeed attachment 4. As was explained above, the center pin 76 is held in the hole 82 in the feeder case 32*a*. Therefore, the center pin 76 and thus the lever 60 move rearward relative to the base casing 30 when the autofeed attachment 4 is contracted.

Figure 10C:
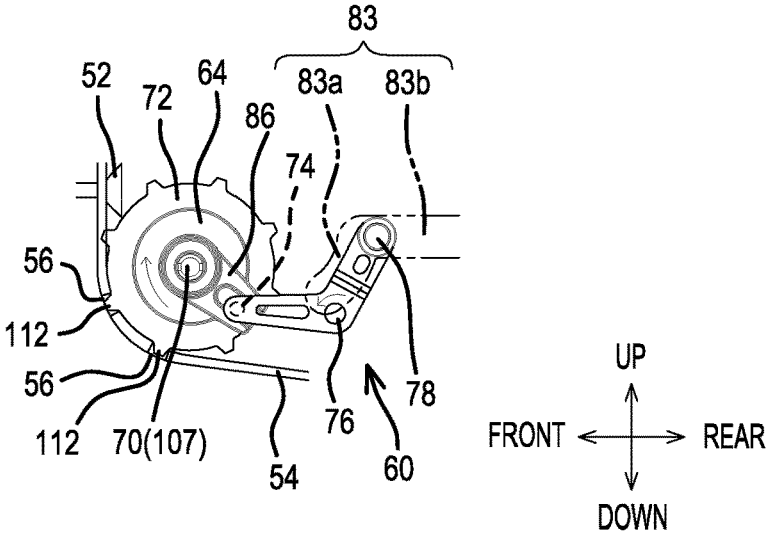
Figure 10D:
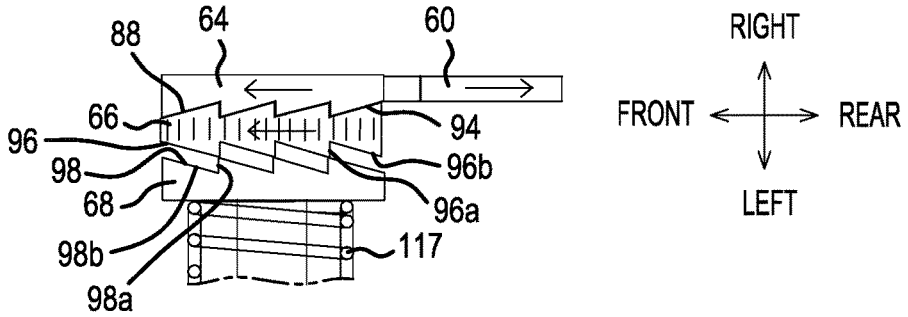

More specifically, as shown in FIG. 10C, the contraction of the autofeed attachment 4 (i.e. the movement of the feeder case 32*a* rearward relative to the base casing 30*a*) causes the rear pin 78 of the lever 60 to rise as it follows (moves diagonally upward and rearward in) the lever-guide front part 83*a*, which causes the lever 60 to pivot (counterclockwise in FIG. 10C) about the center pin 76, whereby the front pin 74 descends. When the front pin 74 descends, it presses against the groove part 86 and causes the first cam 64 to rotate in the clockwise (forward) direction, viewed from the left side, around the shaft 70. As shown in FIG. 10D, this rotation of the first cam 64 is transmitted to the second cam 66 by the engagement of the first steeply inclined surfaces 88*a* of the first teeth 88 and the second steeply inclined surfaces 94*a* of the second teeth 94 and is further transmitted to the wheel 72 via the protrusions 90 and the recessed grooves 92, whereby the wheel 72 rotates in the forward direction in order to upwardly move the screw 52 into the loaded position within the stopper base 32*b* for being driven by the bit. That is, the wheel 72 rotates (in the forward direction) by an amount that causes the feed teeth 112 of the wheel 72 to rise by an amount equal to the spacing of the notches 56 that are adjacent to one another on the connecting strip 54 of the screw strip 50, i.e. the feed teeth 112 rise by 1 pitch.

Therefore, the rotation of the wheel 72 by this amount causes the screw 52 of the screw strip 50 to be advanced (upward) by 1 pitch by the upward movement of the feed teeth 112 that is transmitted to the notches 56 of the connecting strip 54, such that the screw 52 is moved from the (lower) position shown in FIG. 10A to the (higher) position shown in FIG. 10C. Consequently, the screw 52 is moved so that it is positioned forward of the bit in the axial direction of the bit. Therefore, the front (thread) end of the screw 52 is located rearward of the front end (the cap 46) of the stopper base 32*b*.

It is noted that, when the second cam 66 is rotated in this direction (forward direction), the third steeply inclined surfaces 96*a* of the third teeth 96 of the second cam 66 move in a direction away from the fourth steeply inclined surfaces 98*a* and follow the fourth gently inclined surfaces 98*b* of the fourth teeth 98 of the third cam 68. Therefore, the third teeth 96 of the second cam 66 do not engage the fourth teeth 98 of the third cam 68, such that the third cam 68 permits the rotation of the second cam 66 in the appropriate (forward) direction (a one-way clutch). In other words, when the second cam 66 is rotated in the forward direction, the third gently inclined surfaces 96*a* of the rotating second cam 66 slide or slip over the fourth gently inclined surfaces 98*a* of the non-rotating third cam 68 as shown in FIG. 10D so that the third cam 68 does not block or prevent rotation of the second cam 66 in the forward direction.

In addition, before the front end of the screw 52 is pushed through (exits) the screw pass-through slit 45*b* of the cap 46, the bit is inserted into the head of the screw 52 that has been moved so as to be axially forward of the bit.

The user then pulls (squeezes) and holds the trigger 18 while pushing the screwdriver 2 forward to cause the bit to rotate and drive the screw 52 into the workpiece. While the screw 52 is being driven (rotated) by the bit, the attitude (pivot position) of the lever 60 does not change, because the front pin 74 is maintained (held) in the (its) descended state owing to the fact that the rear pin 78 is moved into and then moves along in the lever-guide main body 83*b* that extends straight in the front-rear direction (see also FIG. 8). Thereby, the rotational positions of the first cam 64, the second cam 66, and the wheel 72 are also maintained as is while the screw 52 is being driven (rotated) by the bit.

Thus, the front (thread) part of the screw 52 exits forward through the screw pass-through slit 45*b* of the cap 46 and is inserted (driven) into the work area while being rotated by the bit. It is noted that, at the start of the forward movement caused by the bit, the screw 52 is forcibly separated from the connecting strip 54 by that forward movement.

After the feeder casing 32 has completely entered the base casing 30 and the autofeed attachment 4 has maximally retracted (FIG. 4) or when the screw 52 has been completely inserted (driven) into the work area or workpiece, the user stops pushing the screwdriver 2 forward (i.e. the user moves the screwdriver 2 away from the work area or workpiece), whereby the autofeed attachment 4 returns to the (its) extended state owing to the biasing force of the coil spring 43.

Just before the autofeed attachment 4 completely returns to the (its) extended state, the bit separates from the screw strip 50.

Figure 10E:
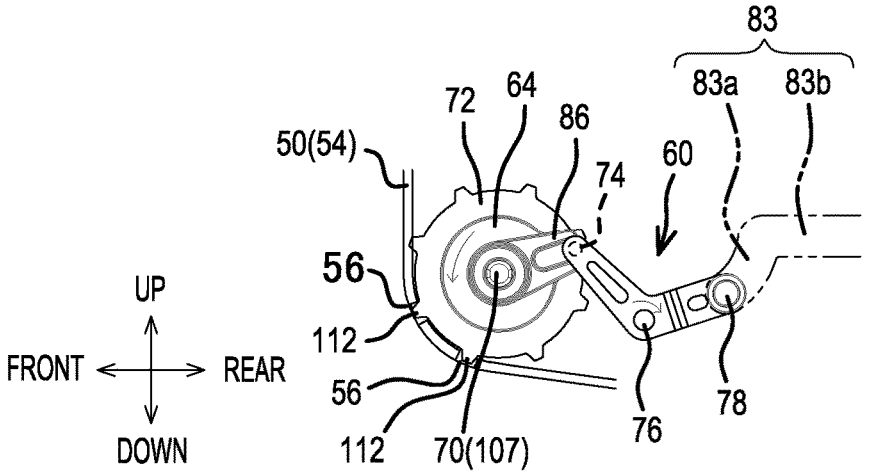
Figure 10F:
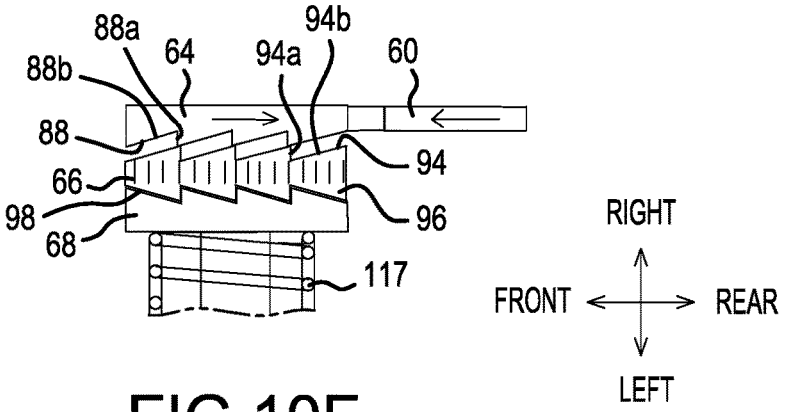

At this time, as shown in FIG. 10E, the rear pin 78 of the lever 60 is caused to move (slide) back into the lever-guide front part 83*a* (due to the forward movement of the feeder box 32*a* relative to the base casing 30), and thereby descends, such that the lever 60 pivots (clockwise in the view of FIG. 10E) about the center pin 76 and causes the front pin 74 to rise. When the front pin 74 rises, the first cam 64 rotates counterclockwise (i.e. in the reverse direction that is opposite of the forward direction), viewed from the left side in FIG. 10E. During this counterclockwise rotation, as shown in FIG. 10F, the first steeply inclined surfaces 88*a* of the first teeth 88 of the first cam 64 move in a direction away from the second steeply inclined surfaces 94*a* and follows the second gently inclined surfaces 94*b* of the right second teeth 94 of the second cam 66. Consequently, the first teeth 88 of the first cam 64 do not engage the second teeth 94 of the second cam 66, such that the torque of the first cam 64 is not transmitted to the second cam 66 (one-way clutch). In other words, when the first cam 64 is caused to rotate in the reverse direction by the pivoting of the lever 60 as the feeder casing 32 moves forward relative to the base casing 30, the first gently inclined surfaces 88*a* of the rotating first cam 64 slide or slip over the second gently inclined surfaces 94*a* of the non-rotating second cam 66 as shown in FIG. 10F so that the second and third cams 66, 68 do not block or prevent rotation of the first cam 64 in the reverse direction.

That is, because the spring 117 is biasing the non-rotatable third cam 68 against the right-facing surface of the second cam 66 at this time, the third steeply inclined surfaces 96*a* of the third teeth 96 of the second cam 66 engage the fourth steeply inclined surfaces 98*a* of the fourth teeth 98 of the non-rotatable third cam 68. Accordingly, because the third cam 68 is held in the cam-receiving part 100 in a non-rotatable manner, the second cam 66 does not rotate in the counterclockwise direction when the first cam 64 rotates counterclockwise (in the reverse direction), viewed from the left side. As a result, the wheel 72 also does not rotate at this time (rotation of the wheel 72 in the reverse direction is restricted), as shown in FIG. 10F.

The user may repeat the cycle of compressing of the autofeed attachment 4, passing through the fully retracted state, and returning to the extended state, such that the screws 52 of the screw strip 50 are successively driven into the workpiece or work area. In this embodiment, the screw strip 50 is advanced only upward (forward) and is never advanced downward (rearward) while the spring 117 is biasing the three cams 64, 66, 68 into engagement. In addition, only the connecting strip 54 exits upward, and the screws 52 to be subsequently supplied are disposed downward.

On the other hand, if the user wishes to remove the screw strip 50 midway (i.e. before all the screws 52 have been removed from the connecting strip 54), then the user may simply pull the screw strip 50 upward when a screw is not being tightened, because the second cam 64 can rotate in the forward direction even while the spring 117 is biasing the three cams 64, 66, 68 into engagement.

In the alternative, the user can also remove the screw strip 50 from below (i.e. by pulling downward) by first pushing the reverse button 107, which is the left end of the shaft 70, to permit rotation of the wheel 72 in the reverse (opposite) direction.

More specifically, as shown in FIGS. 11A and 11B, when the reverse button 107 is not being pressed by the user, the shaft 70 is biased, by the spring 117, leftward via the third cam 68, such that the large-diameter part 102 of the shaft 70 contacts the first cam 64 and separates (is spaced apart) from the second cam 66.

Figure 11C:
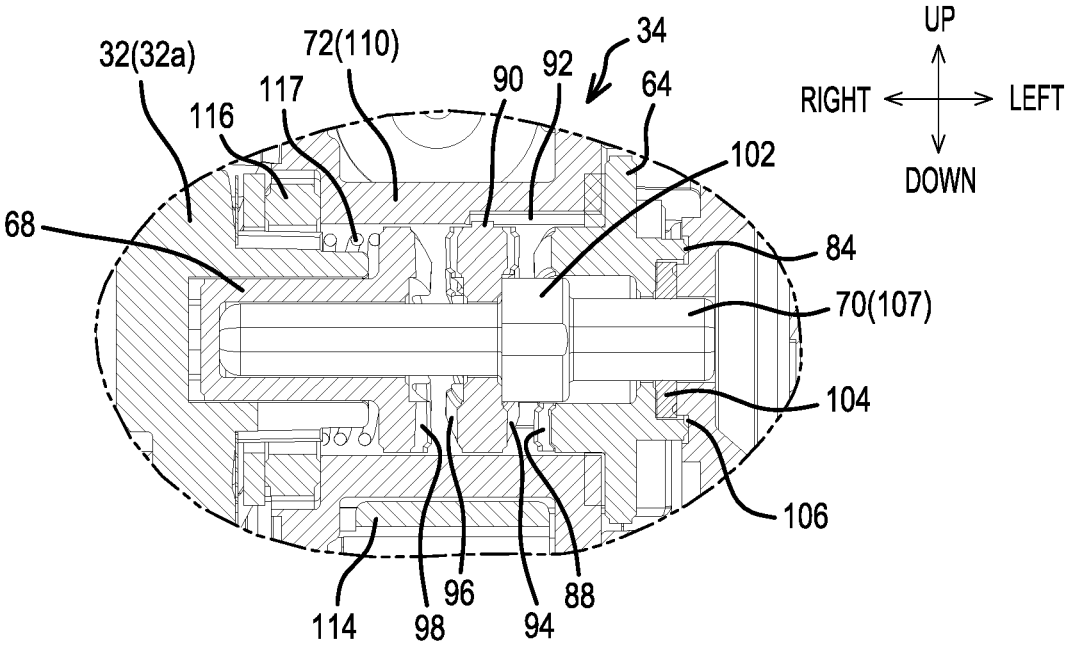
Figure 11D:
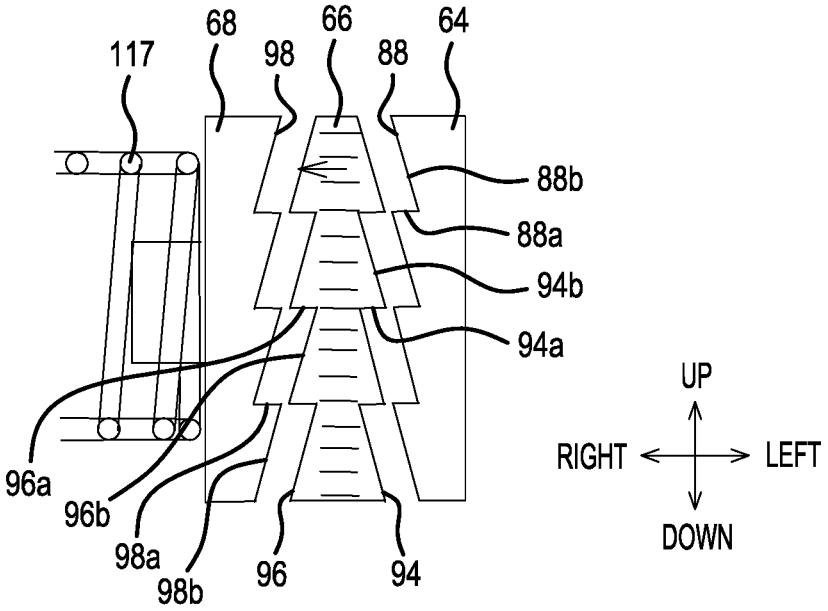

On the other hand, as shown in FIGS. 11C and 11D, when the reverse button 107 is pressed and moves rightward against the biasing force of the spring 117, the third cam 68 first moves rightward and separates (becomes spaced apart) from the second cam 66; subsequently, the large-diameter part 102 pushes the second cam 66 rightward, and thereby the second cam 66 separates (becomes spaced apart) from the first cam 64.

As a result, the fourth teeth 98 of the third cam 68 separate (become spaced apart) from the third teeth 96 of the second cam 66, and also the second teeth 94 of the second cam 66 separate (become spaced apart) from the first teeth 88 of the first cam 64, whereby the second cam 66 becomes rotatable in both directions, as can be seen in FIG. 11D.

Accordingly, in this state (i.e. the reverse button 107 is being pressed rightward in FIG. 11C), the wheel 72 is permitted to rotate both clockwise and counterclockwise without being restricted by the engagement of the first cam 64 and/or the third cam 68 with the second cam 66, which is connected to (interlocked with) the wheel 72. Therefore, when the screw strip 50 is pulled downward, it is not stopped, and the downward withdrawal (rearward withdrawal) of the screw strip 50 is allowed (i.e., this wheel-release mechanism eliminates the restriction on movement in the reverse direction, which is normally imposed by the wheel forward-direction rotating mechanism (which can be considered to be functioning as a kind of one-way clutch) and thus permits removal of the screw strip 50 in the reverse direction that is opposite of the forward direction).

The autofeed attachment 4 and the autofeed screwdriver 1 of the embodiment described above comprise: the base casing 30, which is mounted on the screwdriver 2; the feeder casing 32, which is mounted on the base casing 30 such that the feeder casing 32 is movable in the tightening (driving) direction of the screw 52; the wheel 72, which is provided inside the feeder casing 32 and causes the screw strip 50, which has a plurality of the screws 52 coupled by the connecting strip 54, to advance when the wheel 72 rotates in the forward direction; a wheel forward-direction rotating mechanism, which rotates the wheel 72 in the forward direction and restricts (blocks) rotation in the reverse direction; and a wheel-release mechanism that releases the restriction placed by the wheel forward-direction rotating mechanism on rotation in the reverse direction. Furthermore, the wheel forward-direction rotating mechanism and the wheel-release mechanism are disposed, at least partially or more preferably at least substantially, inside (in the interior) of the wheel 72.

According to this embodiment, the wheel-release mechanism, which makes it possible to easily reversely withdraw (downwardly remove) the screw strip 50, can be embodied in a relatively compact (short) manner in the front-rear direction and in the up-down direction. Furthermore, the wheel 72 protects (shields) the wheel forward-direction rotating mechanism and the wheel-release mechanism from dust and the like generated by the workpiece (e.g., gypsum board) and the like.

In addition, the wheel forward-direction rotating mechanism of the embodiment described above comprises: the first cam 64; the second cam 66, which is connected to (interlocked with) the wheel 72 and is adapted such that the first cam 64 does not engage and rotate the second cam 66 during rotation of the first cam 64 in the reverse direction; and the third cam 68, which is adapted to engage and block rotation of the second cam 66 in the reverse direction during rotation of the first cam 64 in the reverse direction; furthermore, the wheel-release mechanism comprises the shaft 70, which moves the second cam 66 and the third cam 68 in order to separate (space apart) the first cam 64 and the third cam 68 from the second cam 66.

This design enables the autofeed attachment 4 and the autofeed screwdriver 1 to be made more compact and highly durable with respect to dust and the like and enables the simple reverse withdrawal of the screw strip 50.

It is noted that the present teachings are not limited to the above-described embodiments and modified examples; for example, the following modifications can be implemented as appropriate.

In contrast to the front-rear direction, which is the tightening (driving) direction of the screw 52, or the left-right direction, which is the axial direction of the wheel 72, the wheel-release mechanism may be aligned with the wheel 72 in the up-down direction. For example, instead of disposing the first cam 64, the second cam 66 and the third cam 68 and the shaft 70 and the spring 117 in the interior of the wheel 72, a gear with one-way clutch, which meshes with teeth formed on the circular-tubular part 108 of the wheel 72, may be disposed on an upper side (or lower side) of the wheel 72, so as to be movable in the left-right direction by the wheel-release mechanism in the same manner as the spring 117 and the shaft 70. In such a modified embodiment, the wheel 72 is rotatably supported by a separate central axis substituting for the shaft 70, and the lever 60 may be connected to that gear from the rear (or above or below).

In such an embodiment, the gear with one-way clutch and the lever 60 are components of the wheel forward-direction rotating mechanism.

When the wheel-release mechanism is not moving, the gear with one-way clutch engage the teeth of the wheel 72. On the other hand, the gear with one-way clutch separates (becomes spaced apart) from the teeth of the wheel 72 by the operation of the wheel-release mechanism (the pressing down of the shaft 70), thereby permitting rotation of the wheel 72 in both directions.

In such a modified embodiment of the present teachings as well, the screw strip 50 may be easily withdrawn using the wheel-release mechanism and the autofeed attachment 4 may be designed in a compact manner in the front-rear direction.

The shapes of the teeth of the first cam 64, the second cam 66 and the third cam 68 can be variously modified, and any of the steeply inclined surfaces and gently inclined surfaces may be or may partially include a curved surface. In addition, various types of clutches, such as a friction board, may be used for any one of the one-way clutch of the first cam 64, the second cam 66 and the third cam 68 and the one-way clutch in the above-mentioned modified examples.

The sizes of the notches 56 of the connecting strip 54 and the feed teeth 112 of the wheel 72 may be changed, and the notches and the feed teeth may be reversely configured. This likewise applies to any one pair of the protrusions 90 of the second cam 66 and the recessed grooves 92 of the wheel 72, as well as to the various grooves and the various pins and projections inserted therein.

The shaft 70 may move the first cam 64 and the second cam 66, and the first cam 64, the second cam 66 and the third cam 68 may all be moved.

One or both of the coil spring 43 and the spring 117 may be an elastic body (elastomeric member) of some other type, such as a rubber block. This likewise applies to the cap 46.

One or more of the various components and portions may be configured as one body or as a separate body. For example: the motor housing 12 and the gear housing 14 may be one body; the motor-housing main body 12*a* and the grip 12*b* may be separate bodies (the former becoming a motor housing and the latter becoming a grip housing); the reverse button 107 and those portions of the shaft 70 other than the left-end may be separate bodies; and the flanges 110 and the circular-tubular part 108 of the wheel 72 may be separate bodies.

The depth-adjusting dial 40, the depth-adjusting mechanism 41, and the adapter 36 may be omitted. This applies likewise to any one of the various components and portions such as the cap 46, the rib (boss) 84 of the first cam 64, the ring 104, the band 114, and the like.

The connecting strip 54 may be made of a material other than a synthetic resin. Various other materials may be used for other members, such as the felt ring 104.

At least one of the number and arrangement of the air-suction ports 16 can be variously modified. This applies likewise for any one of the trigger 18, the air-exhaust ports 22, the teeth of the first cam 64, the second cam 66 and the third cam 68, the protrusions 90 of the second cam 66 and the recessed grooves 92 of the wheel 72, the large-diameter part 102 of the shaft 70, and the feed teeth 112 of the wheel 72.

Any one of the size and shape of the various members may be variously modified. For example, the lever 60 may be further lengthened, the angles of the corner parts of the lever 60 may be increased (including by 180° or greater) or decreased, and the like.

The types of the various members may be variously modified; for example, the trigger 18 may be configured as a button, the depth-adjusting dial 40 may be configured as an operation (manual) lever, etc.

The motor may include brushes or may be a brushless motor.

Instead of or in addition to the cord-connection part 19, a battery-mounting part, to which a (rechargeable) battery (battery pack or battery cartridge) that supplies electric power to the motor can be mounted, may be provided. In this battery-mounting part, just one battery (battery pack or battery cartridge) may be mountable, or two or more batteries (battery packs or battery cartridges) may be mountable. The battery may be, e.g., any type of lithium-ion battery having a voltage, e.g., of 18-36 V, such as 18 V (max. 20 V), 25.2 V, 28 V, and 36 V; of course, a lithium-ion battery having a voltage that is less than 18 V or exceeds 36 V also may be used; and other types of batteries (battery chemistries) may be used.

In addition, the present teachings can also be suitably adapted to a screw-tightening apparatus other than the screwdriver 2. Furthermore, the present teachings can also be adapted to a screw-feeding apparatus other than the autofeed attachment 4. In addition, the present teachings can also be adapted to a screw-tightening apparatus with screw-feeding apparatus in which the screw-feeding apparatus is inseparably integrated (excepting in the case of extraordinary circumstances, such as a repair) with the screw-tightening apparatus.

In the embodiment shown in the drawings, the cams 64, 66, 68 each have at least one disc surface that extends perpendicular to the rotational axis of the first and second cams 64, 66, which is also the rotational axis of the wheel 72. This rotational axis coincides with a central longitudinal axis of the shaft 70, which supports the rotation of the first and second cams 64, 66, and thus also the wheel 72, and with a central axis of the non-rotatable third cam 68.

The teeth 88, 94, 96 and 98 of the cams 64, 66, 68 each project from the respective disc surface in a direction that is at least substantially parallel to the rotational axes of the cams 64, 66. The steeply inclined surfaces 88*a*, 94*a*, 96*a*, 98*a* preferably extend at an angle of 80-100° to the disc surface, more preferably at an angle of 85-95°, even more preferably 85-92° and most preferably perpendicular to the disc surface (i.e. parallel to the rotational axis). On the other hand, the gently inclined surfaces 88*b*, 94*b*, 96*b*, 98*b* extend at an angle of 5-30° to the disc surface, more preferably at an angle of 8-20°, and even more preferably 10-15°.

The teeth 88, 94, 96 and 98 preferably have a sawtooth shape in cross-section, as shown e.g., in FIGS. 10B, 10D, 10F. The gently inclined surfaces 88*b*, 94*b* of cams 64, 66, respectively, preferably rise in the reverse or second rotational direction of cams 64, 66 (i.e. in the counterclockwise direction when viewed from the left side in FIG. 9), whereas the gently inclined surfaces 96*b*, 98*b* of cams 66, 68, respectively, preferably rise in the forward or first rotational direction of cams 66, 68 (i.e. in the clockwise direction when viewed from the left side in FIG. 9). Thus, the teeth 88, 94, 96 and 98 of the cams 64, 66, 68 are preferably designed such that the engageable teeth (e.g., 96, 98) on one side of the second cam 64 both rise in the forward or first rotational direction, whereas the engageable teeth (e.g., 88, 94) on the opposite side of the second cam 64 both rise in the reverse or second rotational direction that is opposite of the forward or first rotational direction.

According to such a design, when the spring 117 is biasing the cams 64, 66, 68 into engagement and the first cam 64 is rotated in the forward or first rotational direction (see FIG. 10D), the third teeth 96 of second cam 66 are designed to move relative to, and thus slip over, the fourth teeth 98 of the third cam 68 while overcoming the biasing force of the spring 117. That is, in this state, the steeply inclined surfaces 88*a* of the first cam 64 engage and thus move/push the steeply inclined surfaces 94*a* of the second cam 68 in the forward direction (i.e. forward along the rotational axis). However, as was noted above, the third cam 68 is held in the cam-receiving part 100 in a rotationally fixed (non-rotatable) manner. Therefore, rotation of the third cam 68 about its central longitudinal axis, which coincides with the rotational axis of the first and second cams 64, 66, is blocked or prevented by the polygonal engaging structures on the outer surface of the third cam 68 and the corresponding (complementary) engaging (mating) structures on the inner surface of the cam-receiving part 100. Consequently, when the first cam 64 causes the second cam 66 (and thus the wheel 72) to rotate in the forward direction, the third cam 66 does not rotate about its central longitudinal axis such the rotating teeth 96 of the second cam 66 slip over the non-rotating teeth 98 of the third cam 68.

Because the axial position of the first cam 64 is substantially fixed (is axially immovable) by the front pin 74 on the left side and the radially-extending surface of the flange 110 of the wheel 72 on the right side, the rotation of the second cam 66 causes the third cam 68 to slightly axially displace (i.e. by approximately the height of the steeply inclined surface 96*a* of the second cam 66), against the biasing force of the spring 117, in the rightward direction while the third teeth 96 of second cam 66 are moving relative to, and thus slipping over, the fourth teeth 98 of the third cam 68.

On the other hand, when the spring 117 is biasing the cams 64, 66, 68 into engagement and the first cam 64 is rotated in the reverse direction (see FIG. 10F), the first teeth 88 of the first cam 64 are designed to slip over the second teeth 94 of the second cam 66 while overcoming the biasing force of the spring 117, such that the reverse rotation of the first cam 64 is not transmitted to the second cam 66 and thus the wheel 72 does not rotate. In this state, the third steeply inclined surfaces 96*a* of the second cam 66 are blocked by the fourth steeply inclined surfaces 98*a* of the non-rotatable third cam 68, so that the second cam 66 and thus the wheel 72 do not rotate. In this case, the rotation of the first cam 64 in the reverse direction causes the second and third cams 66, 68 to slightly axially displace (i.e. by approximately the height of the steeply inclined surface 88*a* of the first cam 64) in the direction of the rotational axis, against the biasing force of the spring 117, in the rightward direction while the first teeth 88 of first cam 64 are moving relative to, and thus slipping over, the second teeth 94 of the second cam 66.

When the spring 117 is not biasing the cams 64, 66, 68 into engagement (e.g. when the shaft 70 is moved/pushed rightward by manually pressing the reverse button 107), the teeth 94, 96 of the second cam 66 will completely disengage from the teeth 88, 98 of both the first cam 64 and the third cam 68 and thus the second cam 66 will "float" therebetween, such that neither the first cam 64 nor the third cam 68 blocks or prevents rotation of the second cam 66 and thus the wheel 72. Consequently, the second cam 66 and thus the wheel 72 are free to rotate in either the forward or reverse direction in this disengaged state.

In the embodiment shown in the drawings, the central longitudinal axis of the shaft 70, the central longitudinal axis (rotational axis) of the first cam 64, the central longitudinal axis (rotational axis) of the second cam 66, the central longitudinal axis (rotational axis) of the wheel 72 and the central longitudinal axis of the third cam 68 all coincide. Therefore, the rotational axis of the wheel 72 intersects the reverse button 107. Consequently, the feeder box 32*a* may be designed in a relative compact manner in the front-rear direction of the autofeed attachment 4.

Furthermore, because the second cam 66 may be disposed entirely within the left-right dimension of the wheel 72 (i.e. entirely between the two flanges 110 in the left-right direction) and the first cam 64 and the third cam 68 may be disposed at least partially, more preferably at least substantially, within the left-right dimension of the wheel 72 (i.e. partially between the two flanges 110 in the left-right direction), the feeder box 32*a* also may be designed in a relative compact manner in the left-right direction and/or the up-down direction of the autofeed attachment 4.

The term "cam" has been used to identify elements 64, 66, 68 because the teeth slipping action, which takes place when the first cam 64 is rotated, causes at least the non-rotatable (rotationally-fixed) third cam 68 to axially move rightward against the biasing force of the spring 117, although this axial movement of the third cam 68 is not further utilized. Alternate terms for elements 64, 66, 68 include, but are not limited to, slip cam, slip gear, toothed cam, crown gear, sawtoothed gear, sawtoothed crown gear, and sawtoothed cam.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved autofeed attachments for screwdrivers.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Autofeed screwdriver (screw-tightening apparatus with screw-feeding apparatus)
2 Screwdriver (screw-tightening apparatus)
4 Autofeed attachment (screw-feeding apparatus)
30 Base casing
32 Feeder casing
50 Screw strip
52 Screw
54 Connecting strip
64 First cam
66 Second cam
68 Third cam
70 Shaft
72 Wheel

We claim:

1. A screw-feeding apparatus comprising:

a base casing configured to be mounted on a screw-tightening apparatus;

a feeder casing mounted on the base casing such that the feeder casing is movable relative to the base casing in a longitudinal direction of a screw held in the feeder casing;

a wheel rotatably mounted inside the feeder casing and having a central axial through opening, the wheel being configured such that, when the wheel is rotated in a forward direction, the wheel advances a screw strip, which has a plurality of the screws coupled by a connecting strip;

a wheel forward-direction rotating mechanism including at least one cam disposed in the through opening, the wheel forward-direction rotating mechanism being configured to rotate the wheel in the forward direction and restrict rotation of the wheel in a reverse direction that is opposite of the forward direction; and a wheel-release mechanism configured to release the restriction placed by the wheel forward-direction rotating mechanism on rotation in the reverse direction;

wherein the wheel forward-direction rotating mechanism and the wheel-release mechanism are disposed, at least partially, in the central axial through opening.

2. The screw-feeding apparatus according to claim 1, wherein:

the wheel forward-direction rotating mechanism comprises:

a first cam;

a second cam connected to the wheel so as to rotate therewith and configured such that when the second cam engages the first cam, the first cam prevents rotation of the wheel in the reverse direction; and a third cam configured such that when the third cam engages the second cam, the third cam prevents rotation of the wheel in the reverse direction; and the wheel-release mechanism includes a shaft configured to move at least any two of the first cam, the second cam and the third cam to cause the first cam and the third cam to be spaced apart from the second cam so that the second cam and wheel become free to rotate in the reverse direction.

3. The screw-feeding apparatus according to claim 1, wherein:

the at least one cam comprises a first cam and a second cam, and the second cam is disposed entirely in the central axial through opening.

4. The screw-feeding apparatus according to claim 3, including a third cam, wherein the first cam has first cam teeth, the second cam has second cam teeth on a first side of the second cam and third cam teeth on a second side of the second cam and the third cam has fourth cam teeth, and wherein the first cam teeth, second cam teeth, third cam teeth and fourth cam teeth are disposed entirely inside the wheel.

5. A screw-feeding apparatus comprising:

a base casing configured to be mounted on a screw-tightening apparatus;

a feeder casing mounted on the base casing such that the feeder casing is movable relative to the base casing in a front-rear direction;

a wheel rotatably mounted within the feeder casing such that its rotational axis extends in a left-right direction, which is perpendicular to the front-rear direction, and configured such that, when the wheel is rotated in a first rotational direction, the wheel advances a screw strip;

a wheel forward-direction rotating mechanism configured to rotate the wheel in the first rotational direction for advancing the screw strip and to block rotation of the wheel in a second rotational direction that is opposite of the first rotational direction; and a wheel-release mechanism configured to temporarily disable the wheel forward direction rotating mechanism to permit rotation of the wheel in the second rotational direction;

wherein the rotational axis of the wheel intersects a release button of the wheel release mechanism, and wherein:

the wheel forward-direction rotating mechanism comprises:

a first cam;

a second cam interlocked with the wheel so as to rotate therewith and configured such that the first cam does not engage and rotate the second cam during rotation of the first cam in the second rotation direction; and a third cam configured to engage and block rotation of the second cam in the second rotational direction during rotation of the first cam in the second rotational direction; and the wheel-release mechanism comprises a shaft configured to move at least any two of the first cam, the second cam and the third cam to cause the first cam and the third cam to be spaced apart from the second cam so that the second cam and the wheel become free to rotate in the second rotational direction.

6. The screw-feeding apparatus according to claim 5, wherein the wheel forward-direction rotating mechanism and the wheel-release mechanism are disposed, at least partially, inside of the wheel.

7. The screw-feeding apparatus according to claim 5, wherein:

the first cam has first teeth on one side thereof;

the second cam has second teeth on one side thereof and third teeth on an opposite side thereof;

the third cam has fourth teeth on one side thereof;

the first teeth and the second teeth are configured to engage when the first cam is rotated in the forward or first rotational direction, whereby the second cam rotates together with the first cam, and are configured such that the first teeth slide over, without engaging, the second teeth and thereby rotating the second cam when the first cam is rotated in the reverse or second rotational direction; and the third teeth and the fourth teeth are configured such that the third teeth slide over, without engaging, the fourth teeth when the second cam is rotated in the forward or first rotational direction relative to the third cam, and the third teeth and the fourth teeth are configured such that the third teeth engage the fourth teeth when a force is applied to the second cam for rotating the second cam in the reverse or second rotational direction.

8. The screw-feeding apparatus according to claim 7, wherein the third cam is held in a nonrotatable manner.

9. The screw-feeding apparatus according to claim 8, wherein:

the reverse button is defined on a first axial end of the shaft;

the shaft is movable along its axial direction relative to the wheel;

a second axial end of the shaft is disposed in a blind hole defined in the third cam.

10. The screw-feeding apparatus according to claim 9, wherein the wheel-release mechanism comprises a spring that biases the first, second and third cams into contact with each other.

11. The screw-feeding apparatus according to claim 9, wherein the shaft is configured such that pressing the reverse button and moving the shaft along its axial direction relative to the wheel causes the first, second and third cams to disengage and thereby causes the second cam to become freely rotatable both in the forward or first rotational direction and in the reverse or second rotational direction.

12. The screw-feeding apparatus according to claim 11, wherein:

the wheel forward-direction rotating mechanism and the wheel-release mechanism are disposed, at least partially, inside of the wheel;

the wheel-release mechanism comprises a spring that biases the first, second and third cams into contact with each other;

the shaft extends through the first and second cams and into the third cam such that a central longitudinal axis of the shaft coincides with the rotational axis of the wheel;

the first, second, third and fourth teeth each have a sawtooth shape;

the first and second teeth each have an inclined surface that rises in the reverse or second rotational direction;

the third and fourth teeth each have an inclined surface that rises in the forward or first rotational direction; and the wheel forward-direction rotating mechanism comprises a bent lever having a first pin operably coupled to the first cam, a second pin movably disposed in a groove defined in the base casing and a third pin pivotably held in a feeder box of the feeder casing such that movement of the feeder casing relative to the base casing causes the bent lever to pivot about the third pin and thereby rotate the first cam.

13. The screw-feeding apparatus according to claim 7, wherein the first, second, third and fourth teeth each have a sawtooth shape.

14. The screw-feeding apparatus according to claim 7, wherein:

the first and second teeth each have an inclined surface that rises in the reverse or second rotational direction and the third and fourth teeth each have an inclined surface that rises in the forward or first rotational direction.

15. The screw-feeding apparatus according to claim 7, wherein the wheel forward-direction rotating mechanism comprises a bent lever having a first pin operably coupled to the first cam and a second pin movably disposed in a groove defined in the base casing.

16. The screw-feeding apparatus according to claim 15, wherein the bent lever further has a third pin pivotably held in a feeder box of the feeder casing such that movement of the feeder casing relative to the base casing causes the bent lever to pivot about the third pin and thereby rotate the first cam.

17. The screw-feeding apparatus according to claim 5, wherein the shaft extends through the first and second cams and into the third cam such that a central longitudinal axis of the shaft coincides with the rotational axis of the wheel.

18. A screw-feeding apparatus comprising:

a base casing configured to be mounted on a screw-tightening apparatus;

a feeder casing mounted on the base casing such that the feeder casing is movable relative to the base casing in a front-rear direction, which is a longitudinal direction of a screw;

a wheel rotatably mounted inside the feeder casing such that its axial direction extends in a left-right direction, which is perpendicular to the front-rear direction, and configured such that, when the wheel is rotated in a forward direction, the wheel advances a screw strip, which has a plurality of the screws coupled by a connecting strip;

a wheel forward-direction rotating mechanism configured to rotate the wheel in the forward direction and restrict rotation of the wheel in a reverse direction that is opposite of the forward direction, the wheel-forward-direction rotating mechanism including a first cam configured to engage a second cam; and a wheel-release mechanism configured to release the restriction placed by the wheel forward-direction rotating mechanism on rotation of the wheel in the reverse direction;

wherein the wheel includes a left side flange, a right side flange, a tubular member between the left side flange and the right side flange and a central through opening extending from the left side flange through the tubular member and into the right side flange, and wherein the first cam and the second cam are disposed inside the central through opening.

19. The screw-feeding apparatus according to claim 18, wherein a release button of the wheel-release mechanism is located in a plane defined by the up-down direction and the rotational axis of the wheel.

20. The screw-feeding apparatus according to claim 18, wherein the wheel forward-direction rotating mechanism comprises:

a lever having a first end portion operably coupled to the first cam, a second end portion movably disposed in a groove defined in the base casing, and an intermediate portion pivotably held in a feeder box of the feeder casing such that movement of the feeder casing relative to the base casing causes the lever to pivot about the intermediate portion.

21. The screw-feeding apparatus according to claim 18, including a biasing member disposed entirely inside the central through opening.

22. A screw-feeding apparatus comprising:

a base casing configured to be mounted on a screw-tightening apparatus;

a feeder casing mounted on the base casing such that the feeder casing is movable relative to the base casing in a front-rear direction, which is a longitudinal direction of a screw;

a wheel rotatably mounted inside the feeder casing such that its axial direction extends in a left-right direction, which is perpendicular to the front-rear direction, and configured such that, when the wheel is rotated in a forward direction, the wheel advances a screw strip, which has a plurality of the screws coupled by a connecting strip;

a wheel forward-direction rotating mechanism configured to rotate the wheel in the forward direction and restrict rotation of the wheel in a reverse direction that is opposite of the forward direction, the wheel-forward-direction rotating mechanism including a first cam and a second cam and an elastic member; and a wheel-release mechanism configured to release the restriction placed by the wheel forward-direction rotating mechanism on rotation of the wheel in the reverse direction;

wherein:

the wheel includes a left side flange, a right side flange, a tubular member between the left side flange and the right side flange and a central through opening extending from the left side flange through the tubular member and into the right side flange, and the elastic member is disposed inside the central through opening.

* * * * *